US008893788B2

(12) United States Patent
Tunney et al.

(10) Patent No.: US 8,893,788 B2
(45) Date of Patent: Nov. 25, 2014

(54) ENHANCED PERMEABILITY SUBTERRANEAN FLUID RECOVERY SYSTEM AND METHODS

(75) Inventors: Cathal Tunney, Edmonton (CA); Techien Chen, Richmond (CA); Douglas A. Lillico, Edmonton (CA); Justo Neda, Calgary (CA)

(73) Assignee: Alberta Innovates—Technology Futures, Edmonton (CA)

( * ) Notice: Subject to any disclaimer, the term of this patent is extended or adjusted under 35 U.S.C. 154(b) by 468 days.

(21) Appl. No.: 13/234,853

(22) Filed: Sep. 16, 2011

(65) Prior Publication Data

US 2012/0085529 A1 Apr. 12, 2012

(30) Foreign Application Priority Data

Sep. 20, 2010 (CA) ..... 2714935
Sep. 15, 2011 (CA) ..... 2752461

(51) Int. Cl.
*E21B 43/17* (2006.01)
*E21B 43/30* (2006.01)
*E21B 43/24* (2006.01)

(52) U.S. Cl.
CPC ..... *E21B 43/2406* (2013.01); *E21B 43/305* (2013.01)
USPC ..... 166/268; 166/50

(58) Field of Classification Search
CPC ..... E21B 43/122; E21B 43/2406; E21B 43/2408; E21B 43/16
USPC ..... 166/268, 272.7, 50
See application file for complete search history.

(56) References Cited

U.S. PATENT DOCUMENTS

| | | | | |
|---|---|---|---|---|
| 3,565,173 | A * | 2/1971 | Anderson | 166/252.1 |
| 4,442,896 | A | 4/1984 | Reale et al. | |
| 4,479,541 | A | 10/1984 | Wang | |
| 4,633,948 | A * | 1/1987 | Closmann | 166/271 |
| 4,635,720 | A | 1/1987 | Chew | |
| 4,943,189 | A | 7/1990 | Verstraeten | |

(Continued)

FOREIGN PATENT DOCUMENTS

| | | |
|---|---|---|
| WO | 2009018019 | 2/2009 |
| WO | 2010074980 | 7/2010 |
| WO | 2010087898 | 8/2010 |

OTHER PUBLICATIONS

Sharpe, J.A., Shinde, S.B., Wong, R.C., "Cold Lake Borehole Mining," The Journal of Canadian Petroleum Technology, Jan. 1997, vol. 36, No. 1.

(Continued)

*Primary Examiner* — Cathleen Hutchins
(74) *Attorney, Agent, or Firm* — Terrence N. Kuharchuk; Rodman & Rodman

(57) ABSTRACT

A system for recovering a fluid from a subterranean formation, including a production wellbore having a substantially horizontal production length extending through the formation, and a trench extending through the formation. A method of constructing a trench section in a subterranean formation, including providing within the formation an access wellbore having a substantially horizontal access wellbore length, introducing a trench cutting tool into the access wellbore, and advancing and retracting the trench cutting tool through the access wellbore in order to cut slots in the formation in a trench direction away from the access wellbore, repeatedly until a number of slots required to complete the trench section has been cut.

30 Claims, 33 Drawing Sheets

(56) References Cited

U.S. PATENT DOCUMENTS

| | | | | |
|---|---|---|---|---|
| 5,050,386 | A | 9/1991 | Krieg et al. | |
| 5,957,624 | A | 9/1999 | Carter, Jr. et al. | |
| 6,119,776 | A | 9/2000 | Graham et al. | |
| 6,237,701 | B1 | 5/2001 | Kollé et al. | |
| 6,332,652 | B1 | 12/2001 | Nakakuro | |
| 6,708,764 | B2 | 3/2004 | Zupanick | |
| 6,966,374 | B2 * | 11/2005 | Vinegar et al. | 166/272.3 |
| 7,069,989 | B2 | 7/2006 | Marmorshteyn et al. | |
| 7,069,990 | B1 * | 7/2006 | Bilak | 166/271 |
| 7,139,219 | B2 | 11/2006 | Kollé et al. | |
| 7,571,771 | B2 * | 8/2009 | Pratt et al. | 166/313 |
| 7,647,966 | B2 | 1/2010 | Cavender et al. | |
| 7,647,967 | B2 | 1/2010 | Coleman, II et al. | |
| 7,785,040 | B2 | 8/2010 | Kristensen | |
| 2007/0039729 | A1 | 2/2007 | Watson et al. | |
| 2009/0032251 | A1 | 2/2009 | Cavender et al. | |
| 2010/0044042 | A1 | 2/2010 | Carter, Jr. | |
| 2010/0071900 | A1 | 3/2010 | Cavender et al. | |
| 2010/0078218 | A1 | 4/2010 | Coleman, II et al. | |
| 2010/0078220 | A1 | 4/2010 | Coleman, II et al. | |
| 2012/0193094 | A1 * | 8/2012 | Arthur et al. | 166/272.3 |

OTHER PUBLICATIONS

Wong, Ron C.K., 1996, "Behaviour of Water-Jet Mined Caverns in Oil Sand and Shale," Canadian Geotechnical Journal, 33, 610-616.

Barillas, J.L.M., Dutra, Jr., T.V. and Mata, W., "Reservoir and operational parameters influence in SAGD process," Journal of Petroleum Science & Engineering, 54 (2006) 34-42.

"Water-Hammer Valve", HydroPull Brochure 2010, www.tempresstech.com, 4 pages.

Kennedy, J. Editor, "Anaconda drilling system nears commercial rollout," Drilling Contractor, Jul./Aug. 2000, pp. 36-37.

* cited by examiner

ENHANCED PERMEABILITY SUBTERRANEAN FLUID RECOVERY SYSTEM AND METHODS

This application claims the priority of Canadian Patent Application No. 2,714,935 filed Sep. 20, 2010, and the priority of Canadian Application 2,752,461, filed Sep. 15, 2011

TECHNICAL FIELD

A system for recovering a fluid from a subterranean formation which provides enhanced permeability of the subterranean formation, and methods for enhancing the permeability of a subterranean formation.

BACKGROUND OF THE INVENTION

Various technologies exist for recovering hydrocarbon fluids from subterranean formations. With many of these technologies, hydrocarbon fluids are collected in a production wellbore which is positioned in a hydrocarbon containing formation. The flow of hydrocarbon fluids to the production wellbore may be driven by a variety of forces, including natural formation pressure, external pressurization of the formation, fluid injection fluid drive), a combustion front (i.e., in situ combustion) etc.

The flow of hydrocarbon fluids to the production wellbore is dependent upon the magnitude of the driving forces in the formation and upon the mobility of the hydrocarbon fluids in the formation. The mobility of hydrocarbon fluids in a subterranean formation is the ratio of the permeability of the formation to the viscosity of the hydrocarbon fluids. Mobility is therefore a function of both the properties of the hydrocarbon fluids and the properties of the subterranean formation.

For a given magnitude of driving force, the flow of hydrocarbon fluids to the production wellbore may generally be expected to increase as the mobility of the hydrocarbon fluids in the formation increases, either by decreasing the viscosity of the hydrocarbon fluids or by increasing the permeability of the formation.

Options for decreasing the viscosity of hydrocarbon fluids in a subterranean formation include increasing the temperature of the hydrocarbon fluids in the formation and diluting the hydrocarbon fluids in the formation with a less viscous fluid.

Increasing the temperature of the hydrocarbon fluids in the formation may be achieved by injecting steam into the formation in a steam assisted gravity drainage (SAGD) process, by introducing a heat source such as an electrical heater or a radio frequency heater into the formation, by in-situ combustion of the formation, or in some other manner. Diluting the hydrocarbon fluids in the formation may be achieved by injecting a diluent fluid such as a light hydrocarbon fluid or carbon dioxide into the formation.

In some cases, the viscosity of hydrocarbon fluids in a subterranean formation may be decreased both by increasing the temperature of the hydrocarbon fluids in the formation and by diluting the hydrocarbon fluids. For example, in a steam/solvent hybrid process, both steam and a diluent solvent may be injected into the formation to simultaneously heat and dilute the hydrocarbon fluids.

The permeability of a formation may be homogeneous or heterogeneous. In addition, a formation may include one or more discrete permeability barriers. Decreasing the viscosity of the hydrocarbon fluids in the formation may have little effect upon the mobility of the hydrocarbon fluids in the formation if the permeability of the formation is generally low, if the permeability of the formation is heterogeneous, or if there are one or more permeability barriers in the formation.

Furthermore, the presence of low permeability, heterogeneous permeability and/or permeability barriers in a formation may reduce the effectiveness of hydrocarbon recovery processes in the formation.

For example, steam assisted gravity drainage (SAGD) processes and similar processes depend upon permeability of the formation to transfer heat throughout the formation.

Efforts to overcome the effects of low permeability, heterogeneous permeability and/or permeability barriers in a formation are known in the art. Examples include U.S. Pat. No. 4,442,896 (Reale et al), U.S. Pat. No. 4,479,541 (Wang), U.S. Pat. No. 6,708,764 (Zupanick), U.S. Pat. No. 7,069,989 (Marmorshteyn et al), U.S. Pat. No. 7,647,967 (Coleman, II et al), U.S. Patent Application Publication No. US 2010/0078220 A1 (Coleman, II et al), PCT International Publication No. WO 2010/074980 A1 (Carter, Jr.), and PCT International Publication No. WO 2010/087898 (Boone et al).

There remains a need for systems for recovering fluids such as hydrocarbon fluids from a subterranean formation which provide enhanced permeability of the subterranean formation, and for methods for enhancing the permeability of a subterranean formation.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at systems for recovering fluids such as hydrocarbon fluids from a subterranean formation which provide enhanced permeability of the subterranean formation. The present invention is also directed at methods for enhancing the permeability of subterranean formations.

The present invention is more particularly directed at a system which comprises a trench extending through a subterranean formation, at methods for constructing a trench section in a subterranean formation, at methods for constructing a trench in a subterranean formation, and at methods for constructing a system which comprises a trench extending through a subterranean formation.

The system of the invention may be used in a range of fluid recovery processes. In some embodiments, the system of the invention may be used in hydrocarbon recovery processes, including but not limited to gravity drainage processes (such as steam assisted gravity drainage processes, steam/solvent hybrid processes, thermal processes in which heat is introduced into a formation, and in situ combustion processes), cycling injection/production processes (such as cyclic steam stimulation processes), continuous processes, water flooding (displacement) processes, and primary processes (such as fluid drive, gas drive or dissolved gas drive processes).

In an exemplary system aspect, the invention is a system for recovering a fluid from a subterranean formation, the system comprising:

(a) a production wellbore comprising a substantially horizontal production length which extends through the formation; and (b) a trench extending through the formation.

The trench has a trench height which extends between an upper trench edge and a lower trench edge. The trench has a trench length which extends between a distal trench end and a proximal trench end. The trench has a trench width which extends between a first trench side and a second trench side.

In some embodiments, the trench may be substantially planar and may have a trench plane which is defined by the upper trench edge, the lower trench edge, and the trench length. In some embodiments, the upper trench edge may be higher than the lower trench edge. In some embodiments, the trench plane may be substantially vertical.

The trench height may be constant along the trench length, or the trench height may vary along the trench length. The trench width may be constant along the trench height and the trench length, or the trench width may vary along the trench height and/or the trench length.

The trench and the trench plane may be located at any lateral position and any vertical position relative to the production length and may be oriented in any direction relative to the production length.

In some embodiments, the production length and the trench plane may be substantially parallel.

In some embodiments, at least a portion of the production length may be located within the trench. In some embodiments, substantially all of the production length may be located within the trench. In some embodiments, the production length may be offset laterally from the trench plane by a production offset distance.

In embodiments in which the production length is offset laterally from the trench plane, the production offset distance may be any distance for which benefits of the invention may continue to be achieved. In some embodiments, the production offset distance may be less than about 15 meters. In some embodiments, the production offset distance may be less than about 10 meters. In some embodiments, the production offset distance may be less than about 6 meters. In some embodiments, the production offset distance may be less than about 3 meters.

In some embodiments, at least a portion of the trench length may extend along at least a portion of the production length. In such embodiments, a portion of the production length may be located within a portion of the trench or a portion of the production length may be offset from and located adjacent to the trench.

In some embodiments, the trench length may extend uninterrupted along a portion of the production length. In some embodiments, the trench length may extend uninterrupted along substantially the entire production length.

The formation has an upper formation boundary, a lower formation boundary, and a formation thickness which is defined between the upper formation boundary and the lower formation boundary. The formation thickness may be constant throughout the formation or the formation thickness may vary throughout the formation.

In some embodiments, the trench may extend through a portion of the formation thickness. In some embodiments, the trench may extend through substantially the entire formation thickness.

The formation has a formation permeability. The formation permeability may be substantially homogeneous or heterogeneous. If the formation permeability is substantially homogeneous, a relatively consistent permeability may be exhibited throughout the formation. If the formation permeability is heterogeneous, the formation permeability may vary throughout the formation.

In some embodiments, the formation may be comprised of one or more permeability barriers. A permeability barrier may be comprised of any structure in the formation which is relatively less permeable than the average or general formation permeability.

In some embodiments in which the trench extends through a portion of the formation thickness and in which the formation is comprised of a permeability barrier, the trench may extend through the permeability barrier.

In some embodiments in which the trench extends through substantially the entire formation thickness, the formation permeability may be heterogeneous and/or the formation may be comprised of one or more permeability barriers.

In some embodiments in which the trench extends through substantially the entire formation thickness, the upper trench edge may be spaced from the upper formation boundary by an upper boundary distance in order to control heat and/or fluid loss from the trench through the upper formation boundary, and/or the lower trench edge may be spaced from the lower formation boundary by a lower boundary distance in order to control heat and/or fluid loss from the trench through the lower formation boundary.

In embodiments in which the upper trench edge is spaced from the upper formation boundary by an upper boundary distance and/or a lower boundary distance, the amount of the boundary distance may be any distance which is effective to assist in controlling heat and/or fluid loss from the trench through the upper formation boundary. In some embodiments, the upper boundary distance and/or the lower boundary distance may be at least about 3 meters.

The trench width may be any amount which is effective for enhancing the permeability of the formation. In some embodiments, the trench width may be at least about 25 centimeters. In some embodiments, the trench width may be at least about 35 centimeters. In some embodiments, the trench width may be at least about 50 centimeters.

In some embodiments, the trench may be substantially filled with a relatively permeable material. In some embodiments, the relatively permeable material may be an unconsolidated material. In some embodiments, the unconsolidated material may be comprised of a relatively fine particulate material such as sand or fine gravel of the type typically used in wells for gravel packing applications.

The trench has a trench permeability. In some embodiments, the trench permeability, may be substantially homogeneous. In some embodiments in which the formation permeability is substantially homogeneous, the trench permeability may be greater than the substantially homogeneous formation permeability. In some embodiments in which the formation permeability is heterogeneous, the trench permeability may be greater than the average or effective formation permeability. In some embodiments, the trench permeability may be at least about 10,000 millidarcies (mD). In some embodiments, the trench permeability may be at least about 40,000 mD. In some embodiments, the trench permeability may as high as about 100,000 mD. In some embodiments, the trench permeability may exceed 100,000 mD.

In some embodiments, the system may be further comprised of an injection wellbore. In some embodiments, the injection wellbore may comprise a substantially horizontal injection length which extends through the formation at an injection length elevation. In some embodiments, the production length of the production wellbore may have a production length elevation. In some embodiments, the injection length elevation may be higher than the production length elevation.

The trench and the trench plane may be located at any lateral position and any vertical position relative to the production length and the injection length and may be oriented in any direction relative to the production length and the injection length.

In some embodiments, the production length and the injection length may be substantially parallel. In some embodiments, the injection length and the trench plane may be substantially parallel. In some embodiments, the production length, the injection length and the trench plane may be substantially parallel.

In some embodiments, the injection length may be offset laterally from the trench by an injection offset distance.

In embodiments in which the injection length is offset laterally from the trench plane, the injection offset distance may be any distance for which benefits of the invention may continue to be achieved. In some embodiments, the injection offset distance may be less than about 15 meters. In some embodiments, the injection offset distance may be less than about 10 meters. In some embodiments, the injection offset distance may be less than about 6 meters. In some embodiments, the injection offset distance may be less than about 3 meters.

In some embodiments, both the production length and the injection length may be offset laterally from the trench plane by a production offset distance and an injection offset distance respectively.

In some embodiments, the production length elevation may be located between the upper trench edge and the lower trench edge. In some embodiments, the production length elevation may be lower than the lower trench edge. In some embodiments, the production length elevation may be higher than the upper trench edge.

In some embodiments, the injection length elevation may be located between the upper trench edge and the lower trench edge. In some embodiments, the injection length elevation may be lower than the lower trench edge. In some embodiments, the injection length elevation may be higher than the upper trench edge.

In some embodiments, at least a portion of the production length and at least a portion of the injection length may be located within the trench. In some such embodiments, substantially the entire production length may be located within the trench. In some such embodiments, substantially the entire injection length may be located within the trench.

In some embodiments, the production length may be offset laterally from the trench plane by the production offset distance and at least a portion of the injection length may be located within the trench. In some such embodiments, substantially the entire injection length may be located within the trench.

In some embodiments, at least a portion of the production length may be located within the trench and the injection length may be offset laterally from the trench plane by the injection offset distance. In some such embodiments, substantially the entire production length may be located within the trench.

In such embodiments in which the production length and/or the injection length are offset laterally from the trench plane, the offset distance may be any distance for which benefits of the invention may continue to be achieved. In some embodiments, the offset distance may be less than about 15 meters. In some embodiments, the offset distance may be less than about 10 meters. In some embodiments, the offset distance may be less than about 6 meters. In some embodiments, the offset distance may be less than about 3 meters.

In some embodiments, the production length and the injection length may be substantially equal in length and their ends may be substantially adjacent to each other, so that the production length and the injection length are substantially coextensive. In some embodiments, the production length and the injection length may be different in length and their ends may not be substantially adjacent to each other.

In some embodiments, the trench length may extend uninterrupted along a portion of the production length and/or the injection length. In some embodiments, the trench length may extend uninterrupted along substantially the entire production length and/or the entire injection length.

In some embodiments, the trench may be comprised of a plurality of trench sections.

In some embodiments, some or all of the trench sections may be contiguous so that the trench is continuous along the trench length. In some such embodiments, the trench sections may be constructed separately.

In some embodiments, some or all of the trench sections may be separated from each other so that one or more interruptions of the trench or gaps in the trench are provided along the trench length. In some such embodiments, the trench sections may be constructed separately.

In some embodiments, all or a portion of the production length may be lined with a production liner. The production liner may be comprised of any structure which is suitable for lining the production length.

In some embodiments, all or a portion of the injection length may be lined with an injection liner. The injection liner may be comprised of any structure which is suitable for lining the injection length.

The trench and/or trench sections may be constructed in any manner which is suitable to provide a generally continuous trench having a relatively high permeability or an increased permeability relative to the adjacent portions of the formation. The trench may be constructed using any suitable drilling, cutting, channeling, boring and/or tunneling method or combination of methods. Examples of systems, apparatus and methods which may be fully or partially suitable for use in constructing the trench are described in the following published references: U.S. Pat. No. 4,442,896 (Reale et al); U.S. Pat. No. 4,479,541 (Wang); U.S. Pat. No. 4,943,189 (Verstraeten); U.S. Pat. No. 5,957,624 (Carter, Jr. et al); U.S. Pat. No. 6,708,764 (Zupanick); U.S. Pat. No. 6,119,776 (Graham et al); U.S. Pat. No. 7,069,989 (Marmorshteyn et al); U.S. Pat. No. 7,647,966 (Cavender et al); U.S. Pat. No. 7,647,967 (Coleman, II et al); U.S. Patent Application Publication No. US 2007/0039729 A1 (Watson et al); U.S. Patent Application Publication No. US 2010/0044042 A1 (Carter, Jr.); U.S. Patent Application Publication No. US 2010/0078220 A1 (Coleman, II et al); PCT International Publication No. WO 2009/018019 A2 (Schultz et al); PCT International Publication No. WO 2010/074980 A1 (Carter, Jr.); PCT International Publication No. WO 2010/087898 A1 (Boone et al).

In an exemplary method aspect, the invention is a method of constructing a trench section in a subterranean formation comprising:

(a) providing within the formation an access wellbore comprising a substantially horizontal access wellbore length;

(b) introducing a trench cutting tool into the access wellbore; and (c) advancing and retracting the trench cutting tool through the access wellbore in order to cut a slot in the formation from the access wellbore with the trench cutting tool in a trench direction away from the access wellbore, repeatedly until a number of slots required to complete the trench section has been cut.

In some embodiments, the slots may be cut as the trench cutting tool is advancing through the access wellbore. In some embodiments, advancing and retracting the trench cutting tool may be comprised of advancing the trench cutting tool through the access wellbore while cutting the slot in the formation and then retracting the trench cutting tool through the access wellbore. In some embodiments, each of the slots may be cut as upwardly sloping slots.

In some embodiments, the slots may be cut as the trench cutting tool is retracting through the access wellbore. In some embodiments, advancing and retracting the trench cutting tool may be comprised of advancing the trench cutting tool through the access wellbore to a position which defines a distal trench section end and then retracting the trench cutting tool through the access wellbore to a position which defines a proximal trench section end while cutting the slot in the formation.

In some embodiments, the method may further comprise removing debris from the access wellbore. In some embodiments, removing debris from the access wellbore may be performed periodically as the slots are being cut. In some embodiments, removing debris from the access wellbore may be performed after each of the slots is cut.

Removing debris from the access wellbore may be performed in any suitable manner. In some embodiments, removing the debris from the access wellbore may be comprised of flushing the debris from the access wellbore with the trench cutting tool. In some embodiments, the trench cutting tool may be comprised of a jet pump and flushing the debris from the access wellbore with the trench cutting tool may be comprised of circulating the debris through the access wellbore to a ground surface with the jet pump.

The slots may be cut by the trench cutting tool in any manner which is effective for cutting the slots. In some embodiments, the trench cutting tool may be comprised of a mechanical cutting device and the slots may be cut by the mechanical cutting device. In some embodiments, the trench cutting tool may be comprised of a water jet cutting device and the slots may be cut by the water jet cutting device.

In some embodiments, the method may further comprise installing a sacrificial liner in the access wellbore before cutting the slots. In some embodiments, the method may further comprise forming an opening in the sacrificial liner in the trench direction between the distal trench section end and the proximal trench section end before cutting the slots.

In some embodiments, the method may further comprise packing the trench section with a relatively permeable material after cutting the number of slots required to complete the trench section, by introducing the relatively permeable material into the trench section. In some embodiments, the relatively permeable material may be an unconsolidated material. In some embodiments, the unconsolidated material may be comprised of a relatively fine particulate material such as sand or fine gravel of the type typically used in wells for gravel packing applications. In some embodiments, packing the trench section with a relatively permeable material may be comprised of injecting into the trench section a slurry containing the relatively permeable material.

In some embodiments, the method may be further comprised of installing a production liner in the access wellbore after cutting the number of slots required to complete the trench section. In some embodiments, the method may be further comprised of installing a production liner in the trench section. In some embodiments, packing the trench section with a relatively permeable material may be performed after the production liner is installed in the access wellbore or in the trench section.

In some embodiments, the method may be further comprised of installing an injection liner in the access wellbore after cutting the number of slots required to complete the trench section. In some embodiments, the method may be further comprised of installing an injection liner in the trench section. In some embodiments, packing the trench section with a relatively permeable material may be performed after the injection liner is installed in the access wellbore or in the trench section.

In some embodiments, the method may be comprised of constructing a trench in a subterranean formation, wherein the trench is comprised of one or more trench sections.

In some embodiments, the method may be comprised of constructing the system of the invention, wherein the system is comprised of a trench extending through a subterranean formation, and wherein the trench is comprised of one or more trench sections.

In some embodiments, the trench and/or the system of the invention (including a trench) may serve one or more of the following purposes:

1. facilitate more rapid startup or initialization of processes such as SAGD processes, by providing for enhanced circulation through the formation of steam or other mobilizing fluids;
2. facilitate drainage and recovery of one or more produced fluids from the formation, including but not limited to bitumen, diluted bitumen, heavy oil, other hydrocarbons, and condensed steam;
3. facilitate recovery of one or more produced gas phases from the formation, including but not limited to hydrocarbon gases, product gases from in situ combustion, carbon dioxide etc.;
4. facilitate providing additional geological information about the formation, including but not limited to composition, permeability and porosity data;
5. facilitate injection of one or more mobilizing fluids into the formation, including but not limited to steam, water, hydrocarbon solvents, and air/oxygen for in situ combustion; and
6. enable larger vertical spacing between the production length and the injection length of a SAGD well pair in a formation, thereby providing better control over the liquid trap.

In some particular embodiments in which the system of the invention may be utilized in a SAGD type process, the system may result in improved economic performance as a result of more attractive oil recovery curves (more oil and sooner). Without intending to be bound by theory, such improved recovery curves may result from a shortened initialization phase, an increased rate of development of the steam chamber to full height, an early and more uniform development of the steam chamber along the full length of the SAGD well pair, and/or the creation of vertical pathways for fluid flow through the low permeability barriers;

In some other embodiments of the invention, the trench may be utilized to provide reduced permeability through the formation. In such embodiments, one or more blocking agents, including but not limited to cement, mortar, concrete, liquid sulphur, blocking polymers, wax, clays etc. may be introduced into the trench so that the trench provides reduced permeability relative to the formation. Such reduced permeability may be effective for restricting the ingress of water from water saturated zones into the formation, for restricting the loss of injectants (such as steam) to low pressure "thief" zones in a formation, or for a variety of other purposes.

BRIEF DESCRIPTION OF DRAWINGS

Embodiments of the invention will now be described with reference to the accompanying drawings, in which.

DETAILED DESCRIPTION

The present invention is directed at a system for recovering a fluid from a subterranean formation which provides enhanced permeability of the subterranean formation. The present invention is also directed at a method for enhancing the permeability of a subterranean formation.

Figure 1D:
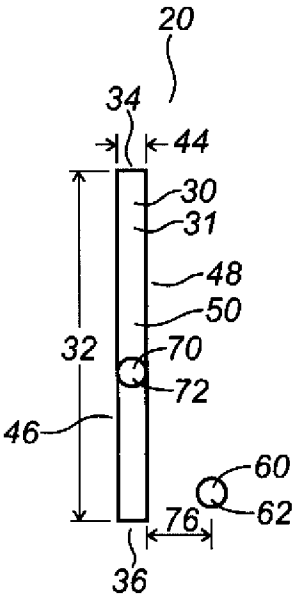
FIGS. 1A-1D are schematic end elevation views of four exemplary configurations of a System according to the invention, including a SAGD well pair and a trench.
Figure 1C:
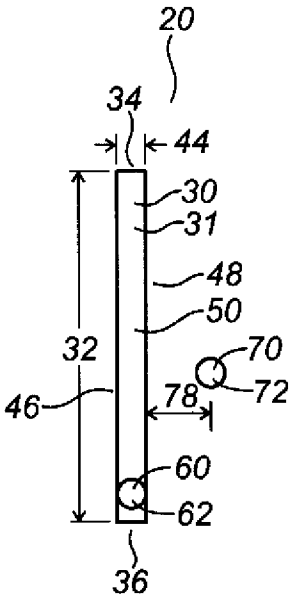
Figure 1B:
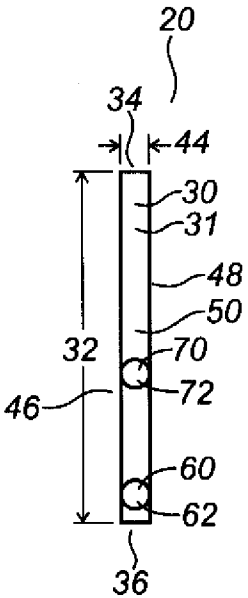

Referring to FIGS. 1A-1D, four exemplary configurations of a system according to the invention are depicted in schematic end elevation views. Referring to FIGS. 2A-2C, three exemplary configurations of a system according to the invention are depicted in schematic side elevation views.

Referring to FIGS. 1A-1D and FIGS. 2A-2C, the system (20) is located in a subterranean formation (22). The formation (22) contains one or more substances, such as hydrocarbons, which are desired to be produced from the formation (22). In exemplary embodiments of the invention, the formation (22) may contain heavy oil or oil sand, which typically exhibit high viscosity and low mobility in situ.

The formation (22) has an upper formation boundary (24), a lower formation boundary (26), and a formation thickness (28).

The system (20) is comprised of a trench (30) extending through the formation (22). The trench (30) has a trench height (32) which extends between an upper trench edge (34) and a lower trench edge (36). The trench (30) has a trench length (38) which extends between a distal trench end (40) and a proximal trench end (42). The trench (30) has a trench width (44) which extends between a first trench side (46) and a second trench side (48).

As depicted in FIGS. 1A-1D and FIGS. 2A-2C, the trench (30) is substantially planar. The upper trench edge (34), the lower trench edge (36) and the trench length define a trench plane (50). As depicted in FIGS. 1A-1D and FIGS. 2A-2C, the upper trench edge (34) is above the lower trench edge (36) and the trench (30) is substantially vertical.

The system (20) is further comprised of a production wellbore (60). The production wellbore (60) comprises a substantially horizontal production length (62) which extends through the formation (22) at a production length elevation (64).

In the exemplary embodiments depicted in FIGS. 1A-1D and FIGS. 2A-2C, the system (20) is further comprised of an injection wellbore (70). The injection wellbore (70) comprises a substantially horizontal injection length (72) which extends through the formation (22) at an injection length elevation (74).

As depicted in FIGS. 1A-1D and FIGS. 2A-2C, the injection length elevation (74) is higher than the production length elevation (64). As depicted in FIGS. 1A-1D and FIGS. 2A-2C, the trench plane (50), the production length (62) and the injection length (72) are substantially parallel. As depicted in FIGS. 1A-1D and FIGS. 2A-2C, the production length (62) and the injection length (72) are substantially coextensive.

As depicted in FIGS. 1A-1D and FIGS. 2A-2C, the trench (30) is substantially filled with a relatively permeable material (31) which is comprised of an unconsolidated material. In the exemplary embodiments, the unconsolidated material is comprised of a relatively fine particulate material such as sand or fine gravel of the type typically used in wells for gravel packing applications.

Figure 1A:
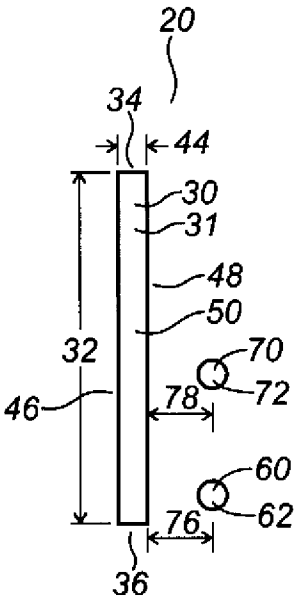
Figure 2A:
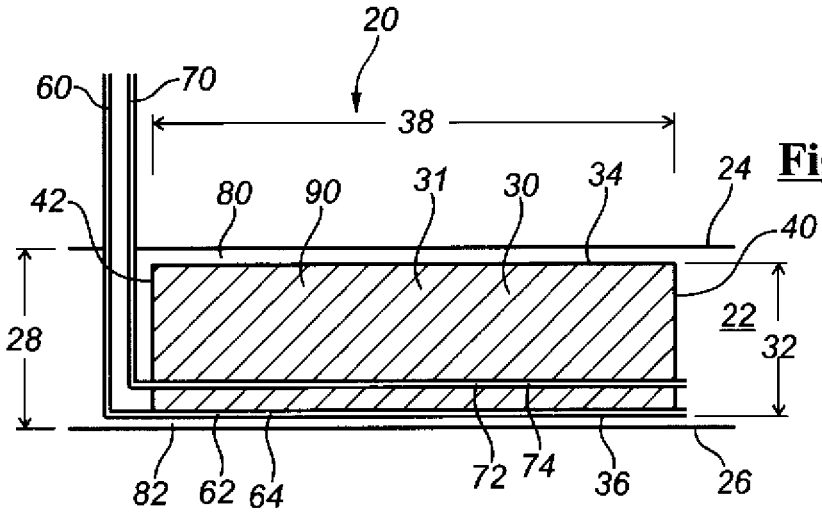
FIGS. 2A-2C are schematic side elevation views of three exemplary system configurations according to the invention, including a SAGD well pair and a trench.
Figure 2B:
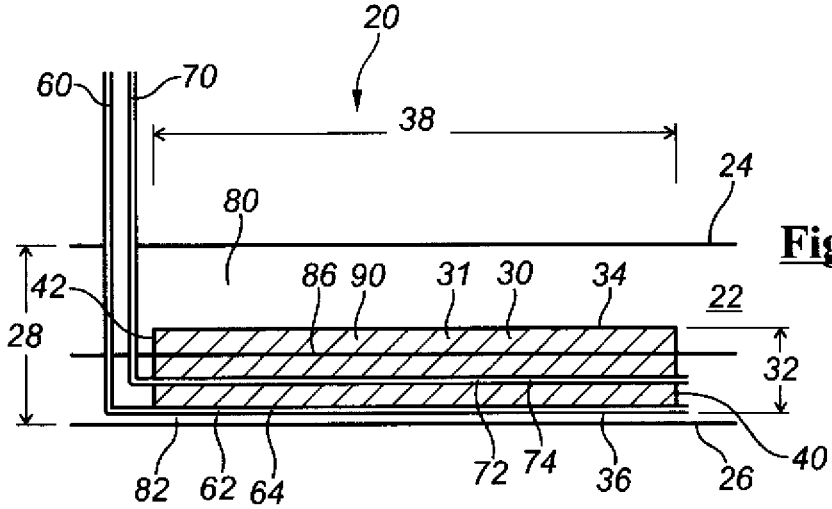
Figure 2C:
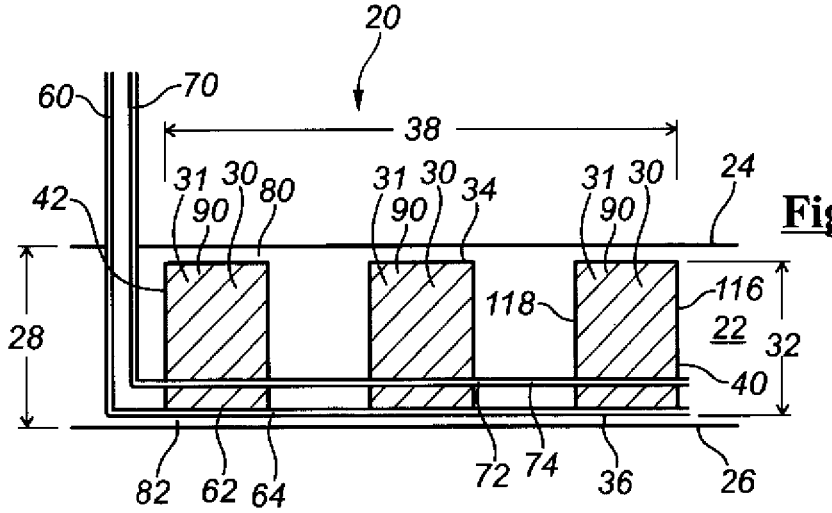

Referring to FIG. 1A, there is depicted a configuration of the system (20) in which the production length (62) and the injection length (72) are both offset laterally from the trench plane (50) such that no portion of the production length (62) and the injection length (72) are located within the trench (30). The production length (62) is offset laterally from the trench plane (50) by a production offset distance (76). The injection length (72) is offset laterally from the trench plane (50) by an injection offset distance (78).

Referring to FIG. 1B, there is depicted a configuration of the system (20) in which at least a portion of the production length (62) and at least a portion of the injection length (72) are located within the trench (30).

Referring to FIG. 1C, there is depicted a configuration of the system (20) in which at least a portion of the production length (62) is located within the trench (30) and in which the injection length (72) is offset laterally from the trench plane (50) by the injection offset distance (78).

Referring to FIG. 1D, there is depicted a configuration of the system (20) in which the production length (62) is offset laterally from the trench plane (50) by the production offset distance (76) and in which at least a portion of the injection length (72) is located within the trench (30).

Referring to FIG. 2A, there is depicted a configuration of the system (20) in which the trench (30) extends uninterrupted along substantially the entire production length (62) and substantially the entire injection length (72). In the configuration depicted in FIG. 2A, the trench (30) extends through substantially the entire formation thickness (28), except for an upper boundary distance (80) between the upper formation boundary (24) and the upper trench edge (34) and a lower boundary distance (82) between the lower formation boundary (26) and the lower trench edge (36).

Referring to FIG. 2B, there is depicted a configuration of the system (20) in which the trench (30) extends uninterrupted along substantially the entire production length (62) and substantially the entire injection length (72). In the configuration depicted in FIG. 2B, the trench (30) extends only through a portion of the formation thickness (28). In the configuration depicted in FIG. 2B, the formation (22) is comprised of a permeability barrier (86) and the trench (30) extends through the permeability barrier (86).

Referring to FIG. 2C, there is depicted a configuration of the system (20) in which the trench (30) is comprised of a plurality of trench sections (90) with interruptions or gaps between them, so that the trench (30) extends interrupted along substantially the entire production length (62) and substantially the entire injection length (72). In the configuration depicted in FIG. 2C, the trench (30) extends through substantially the entire formation thickness (28), except for an upper boundary distance (80) between the upper formation boundary (24) and the upper trench edge (34) and a lower boundary distance (82) between the lower formation boundary (26) and the lower trench edge (36).

In each of the system configurations depicted in FIGS. 1A-1D and FIGS. 2A-2C, all or a portion of the production length (62) may be lined with a production liner (100) and all or a portion of the injection length (72) may be lined with an injection liner (102).

Simulation studies have been conducted to investigate the benefits of a system (20) according to the invention, and to investigate the effect of modifying various design parameters for the system (20). A discussion of these simulation studies follows.

Simulation Studies

Simulation studies were conducted for a steam assisted gravity drainage (SAGD) process including a well pair consisting of a production wellbore (60) and an injection wellbore (70), using various configurations of a system (20) according to the invention.

The simulation studies were conducted using STARS simulation software, Version 2007.11, a product of Computer Modelling Group Ltd. of Calgary, Alberta, Canada.

1. Homogeneous Formation Model Studies

A simple homogeneous model incorporating a discrete and definitive permeability barrier (86) was used to perform a preliminary evaluation of the effectiveness of a vertical trench (30). The permeability barrier (86) was located at approximately one third of the formation thickness (28) below the upper formation boundary (24). The parameters which were used in the homogeneous model are presented in Table 1.

TABLE 1

| PARAMETER DESCRIPTION | PARAMETER VALUE |
|---|---|
| Single Pair SAGD | 2D & 3D Cases |
| Formation Thickness | 35 Meters |
| Vertical Distance Between Production Wellbore and Injection Wellbore | 5 Meters |
| Porosity of Formation | 35 Percent |
| Oil Saturation (So) of Formation | 85 Percent |
| Water Saturation (Sw) of Formation | 15 Percent |
| Permeability Barrier Thickness | 4 Meters |
| Vertical Permeability (Kv) of Formation | 3000 mD |
| Horizontal Permeability (Kh) of Formation | 6000 mD |
| Permeability of Permeability Barrier (K) | 10 mD |
| Porosity of Permeability Barrier (φ) | 6 Percent |
| Permeability of Trench (K) | 10,000 mD |
| Porosity of Trench (φ) | 38 Percent |
| Temperature of Formation | 13 Degrees Celsius |
| Formation Pressure | 2000 kPa |
| Viscosity of Oil/Hydrocarbons | 1,224,544 cP |
| GOR | 4,214 standard $m^3/m^3$ |

TABLE 1-continued

| PARAMETER DESCRIPTION | PARAMETER VALUE |
|---|---|
| Steam Injection Pressure | 4000 kPa at 250 Degrees Celsius and 90 Percent Quality |

The main findings and conclusions obtained using the simplified 2D simulation model, using cumulative oil production as the performance criterion, can be summarized as follows:

1. a steam chamber can be developed above a permeability barrier (86) by implementing the trench (30);
2. additional oil is recovered by drainage through the trench (30);
3. variations on the trench (30) location provide similar results as long as the trench (30) cuts through the permeability barrier (86); and
4. provided that the location and extent of the permeability barrier (86) is known, the trench (30) need do no more than span the thickness of the permeability barrier (86).

Figure 3:
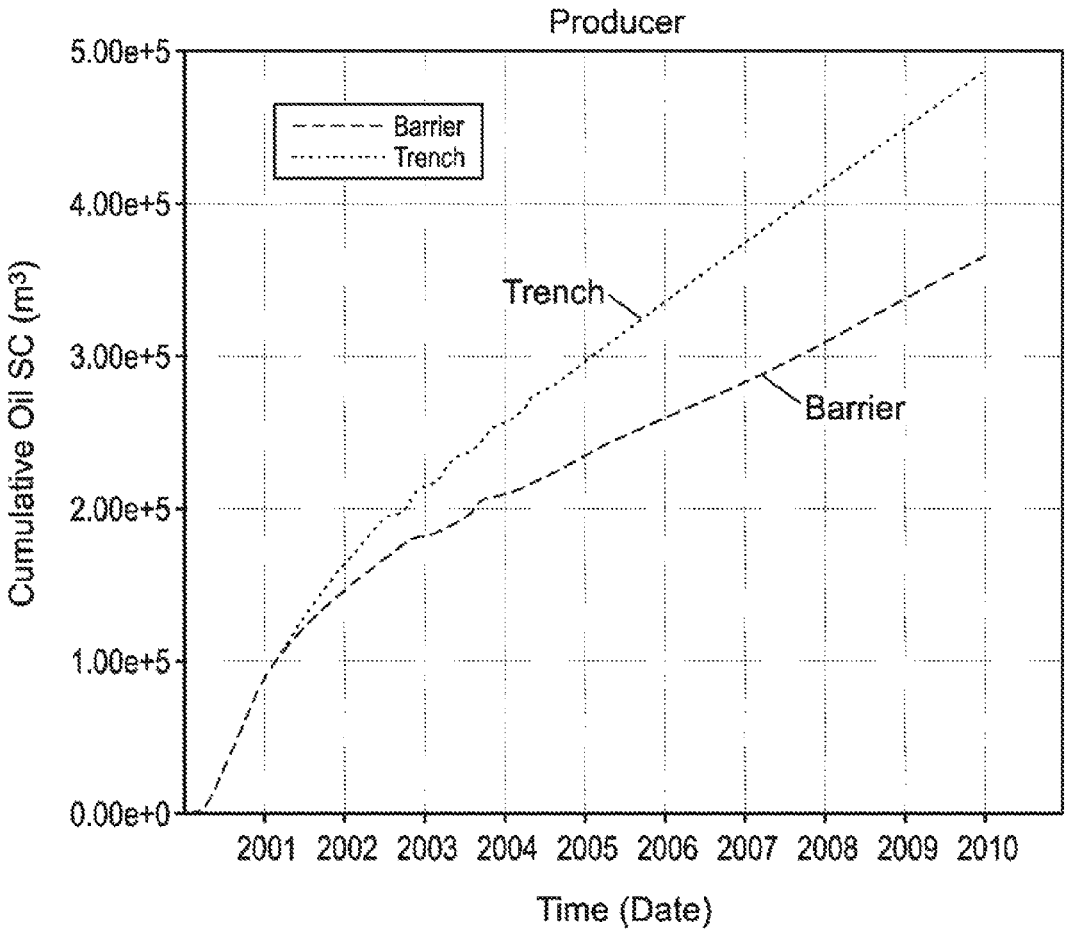
FIG. 3 is a graph of cumulative oil recovery for a SAGD well pair as a function of time from a 2D simulation model, comparing cumulative oil recovery for a system including a trench extending through a permeability barrier and cumulative oil recovery without a trench.
Figure 4:
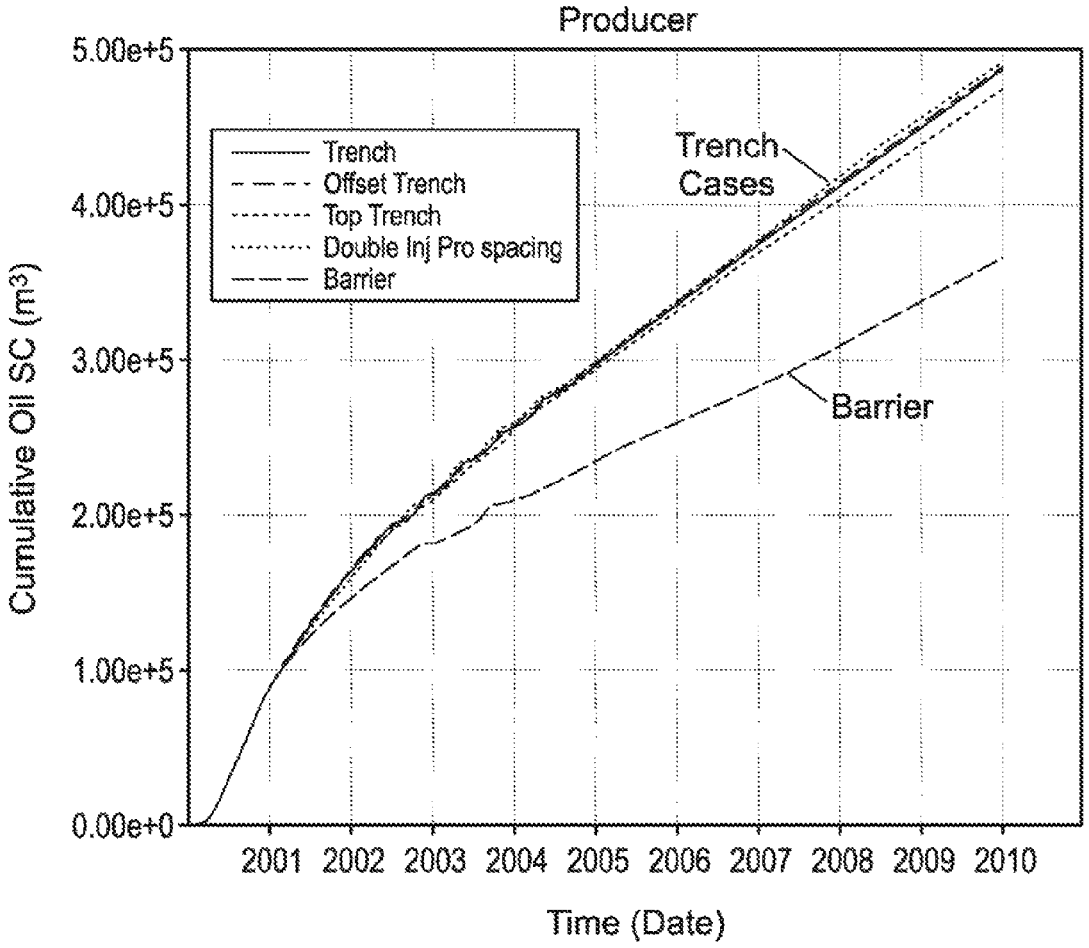
FIG. 4 is a graph of cumulative oil recovery for a SAGD well pair as a function of time from a 2D simulation model, comparing cumulative oil recovery for different system configurations with a trench extending through a permeability barrier and cumulative oil recovery without a trench.

FIG. 3 and FIG. 4 illustrate the results for the 2D simulations studied.

A 3D version of the homogeneous model was used to further investigate the effect of various system (20) configurations. In all cases the SAGD well pair is in the same vertical plane as the trench (30). The system (20) configurations were as follows:

"Full": means that the trench (30) extends substantially a full height through the entire formation thickness (28) and extends an uninterrupted full length along substantially the entire production length (62) and the entire injection length (72);

"Top": means that the trench (30) extends vertically a partial height only through the thickness of the permeability barrier (86), but extends an uninterrupted full length along substantially the entire production length (62) and the entire injection length (72);

"Half":means that the trench (30) extends substantially a full height through the entire formation thickness (28) but extends an uninterrupted partial length over half the production length (62) and half the injection length (72). More particularly, the model was constructed by placing the trench (30) half of the distance from the heel towards the toe (400 meters) of the production length (62) and the injection length (72), so that the trench length represented 50% of the production length (62) and the injection length (72); and "Every 100 meters": means that the trench (30) extends substantially a full height through the entire formation thickness (28), but is constructed as a plurality of 100 meter long trench sections (90) having 100 meter gaps between them. As a result, the trench (30) extends an interrupted full length along substantially the entire production length (62) and the entire injection length (72) with the trench sections (90) covering 50% of the production length (62) and the injection length (72). This configuration potentially provides better prospects for a uniform heat distribution in comparison with the "Half" configuration.

The main findings and conclusions obtained using the simplified 3D models are summarized as follows:

1. a steam chamber can develop above a permeability barrier (86) by implementing the trench (86). The 3D simulation gives some idea about performance along the production length (62) of the production wellbore (60);
2. additional oil can be recovered by draining through the trench (30) along the production length (62);

3. a trench (30) which does not extend uninterrupted along substantially the entire production length (62) and along substantially the entire injection length (72) will produce a lower cumulative oil recovery than a trench (30) which does extend uninterrupted along substantially the entire production length (62) and along substantially the entire injection length (72); and
4. extending the trench (30) uninterrupted along substantially the entire production length (62) and along substantially the entire injection-length (72) but only across the permeability barrier (86) (i.e., Top versus Full configuration) shows equivalent cumulative oil recovery results. However, to implement this configuration the location of the permeability barrier must be known beforehand. In practice, a trench (30) extending through substantially the entire formation thickness (28) and extending uninterrupted along substantially the entire production length (62) and along substantially the entire injection length (72) may give more consistent and predictable results.

Figure 5:
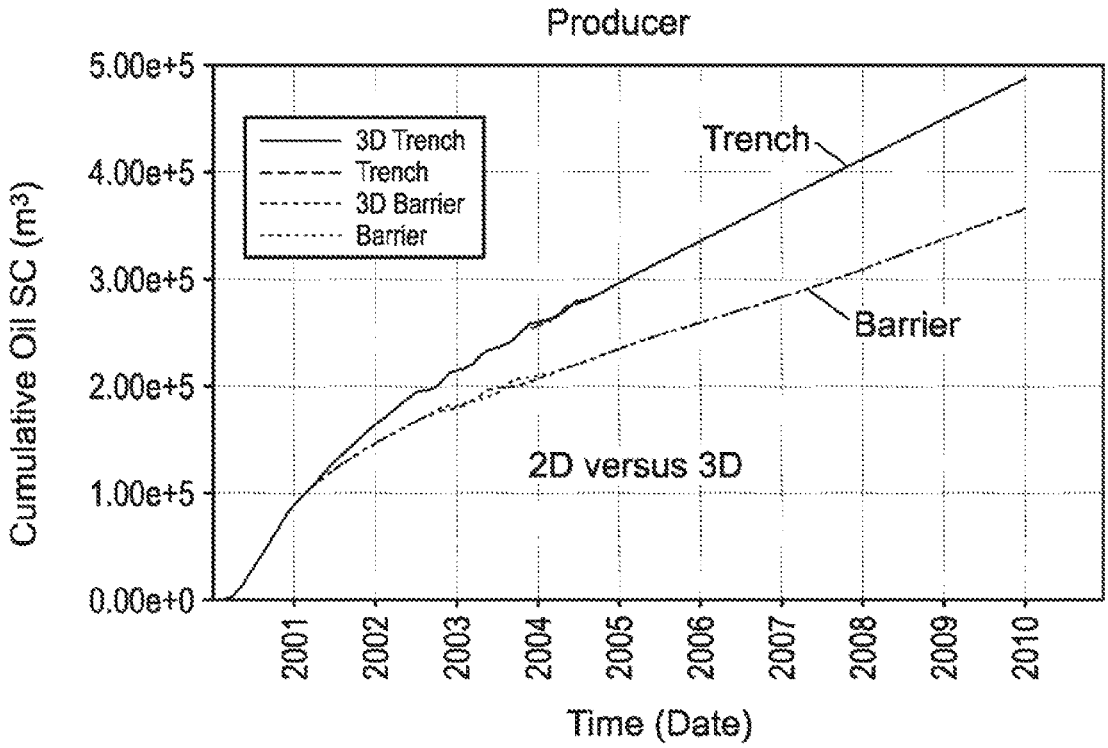
FIG. 5 is a graph of cumulative oil recovery for a SAGD well pair as a function of time, comparing cumulative oil recovery for a system including a trench extending through a permeability barrier and cumulative oil recovery without a trench, from both a 2D simulation model and a 3D simulation model.

FIG. 5 compares the results for the simple 2D and 3D models. Both show equivalent cumulative oil recovery performance for implementation of a trench (30).

Figure 6:
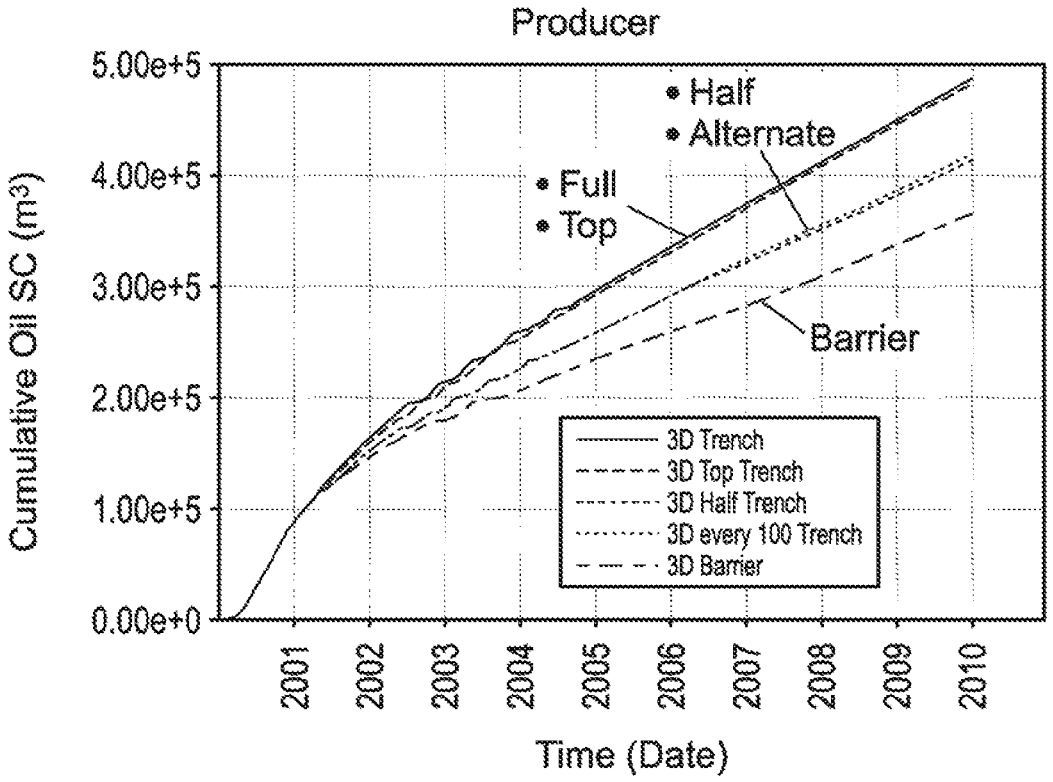
FIG. 6 is a graph of cumulative oil recovery for a SAGD well pair as a function of time from a 3D simulation model, comparing cumulative oil recovery for different system configurations including a trench and cumulative oil recovery without a trench.

Cumulative oil recovery performance for the system (20) configurations described above is shown in FIG. 6.

Figure 7:
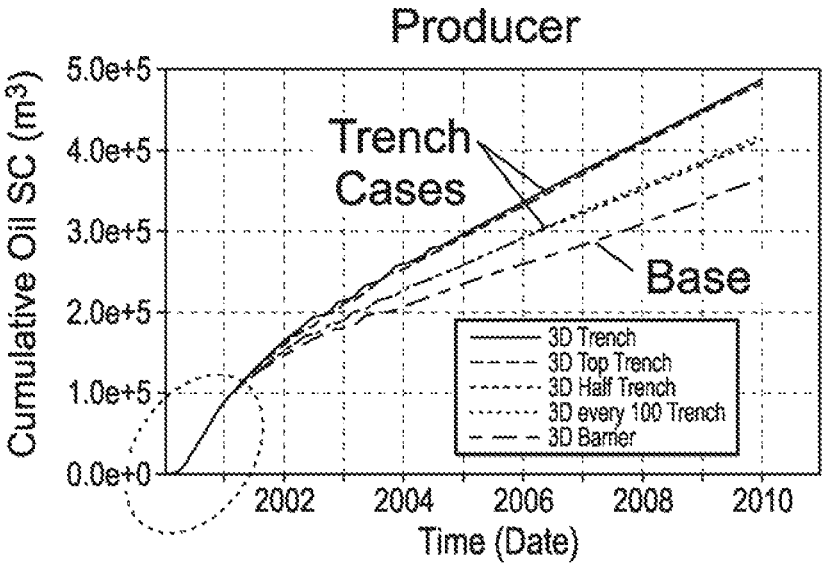
FIG. 7 is a series of graphs of cumulative oil recovery for a SAGD well pair as a function of time, comparing cumulative oil recovery for different system configurations including a trench and cumulative oil recovery without a trench, for both a homogeneous formation containing a permeability barrier and for a heterogeneous formation.
Figure 7:
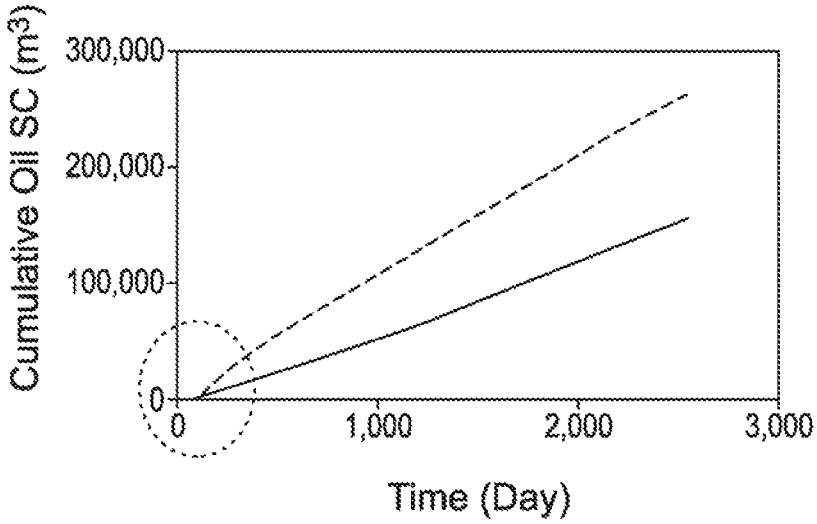

2. Comparison of Trench Performance for Homogeneous and Earlier Heterogeneous Models Comparing the results of the above homogeneous formation model studies to an earlier preliminary analysis that used a 2D heterogeneous model and a full height trench (30), it appears that a full height trench (30) provides incremental benefits (beyond cutting through a permeability barrier (86)) for heterogeneous formations. This can be seen in FIG. 7 where the heterogeneous model produces a 70% improvement in cumulative oil recovery versus a 33% improvement for the homogeneous model. Also, it is clear from FIG. 7 that for the heterogeneous model the trench (30) yields improved oil recovery rates right from the beginning relative to the "no trench" benchmark whereas this performance improvement is delayed in studies with a homogeneous model. This observation supports the hypothesis that a trench (30) could provide early and more effective flow communication with all productive intervals in a heterogeneous formation and not just those isolated by a well-defined permeability barrier.

The above noted differences in predicted performance for homogeneous formation versus heterogeneous formation models led to the conclusion that further simulation studies using a heterogeneous model were merited.

3. Heterogeneous Formation Model Studies

The heterogeneous formation model which was used in the further simulation studies incorporated permeability contrasts that effectively blocked full height SAGD steam chamber development.

The heterogeneous formation model selected was deemed to exhibit a reasonable combination of good permeability layers with low permeability layers acting as partial or complete barriers to vertical flow of both injected steam and produced liquids. The model included heterogeneous layers with their corresponding petro-physical information such as porosity, permeability, relative permeability and water saturation.

A series of SAGD simulations were run using this heterogeneous model to compare the performance of a conventional SAGD configuration with a SAGD well-pair and trench (36) configuration, in accordance with the system of the invention. In the Figures described below the conventional SAGD configuration is designated as "No Trench" and is shown on the left side of the Figures whereas the configuration in accordance with the system of the invention is designated simply as "Trench" and is presented on the right side of the Figures.

Figure 8:
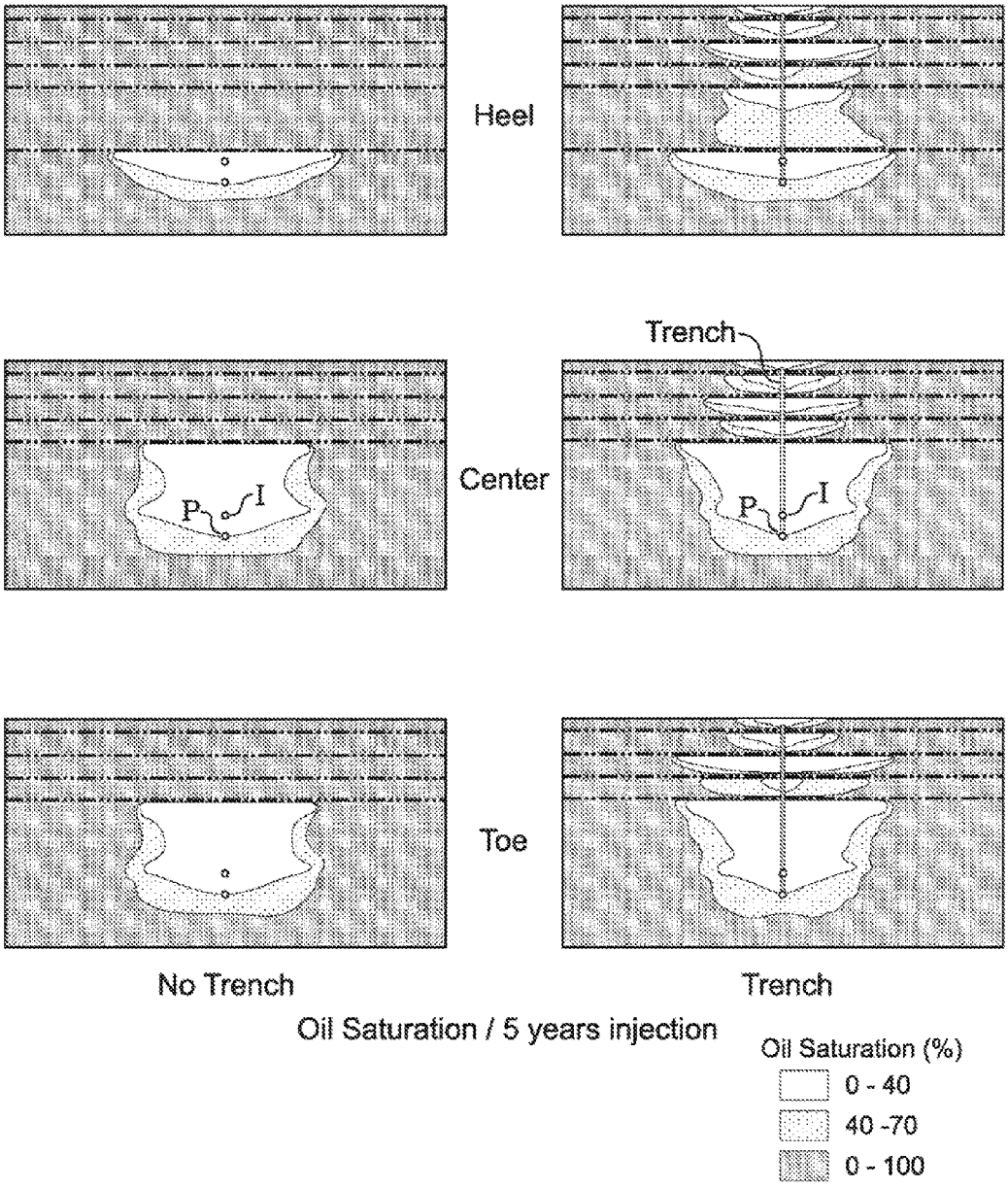
FIG. 8 is a series of graphs depicting oil saturation in the vicinity of a SAGD well pair in a heterogeneous formation after five years of steam injection at a Heel zone, a Center zone and a Toe zone, for both a Trench configuration (i.e., a system including a trench) and a No Trench configuration.
Figure 9:
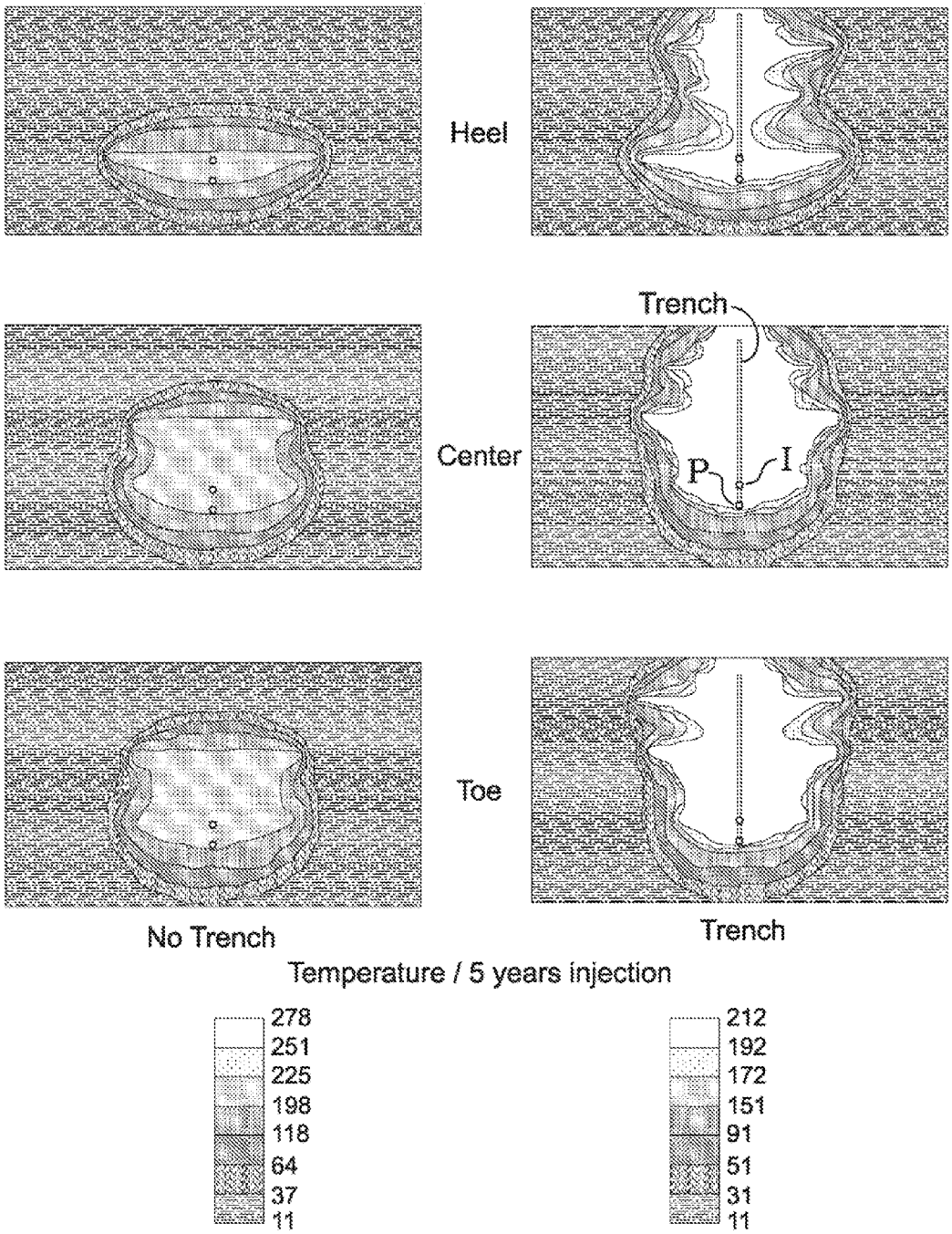
FIG. 9 is a series of graphs depicting temperature distribution in the vicinity of a SAGD well pair in a heterogeneous formation after 5 years of steam injection at a Heel zone, a Center zone and a Toe zone, for both a Trench configuration (i.e., a system including a trench) and a No Trench configuration.

FIGS. 8 and 9 show how oil saturation and temperature distribution compares at 3 different locations along the well pair after 5 years of steam injection. It appears obvious that the trench (30) may be effective in providing early and more extensive formation access. Steam can flow upward through the trench (30) as well as horizontally through the higher permeability layers providing more effective heating to the formation all along the pay zone.

Figure 10:
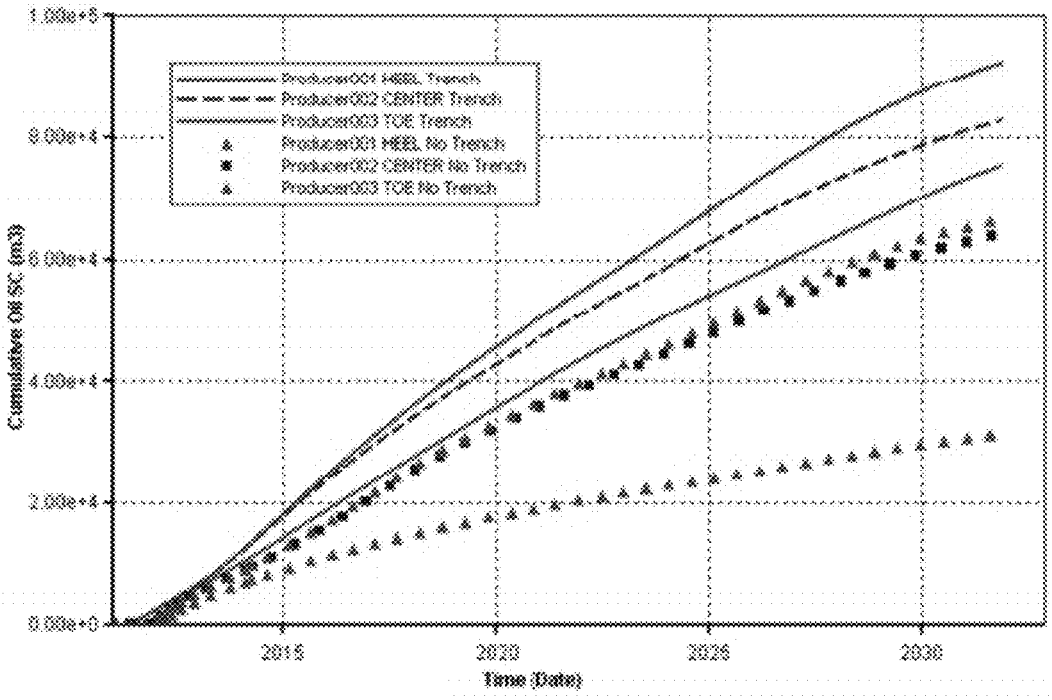
FIG. 10 is a graph of cumulative oil recovery for a SAGD well pair in a heterogeneous formation as a function of time, comparing cumulative oil recovery at a Heel zone, a Center zone and a Toe zone for both a Trench configuration (i.e., a system including a trench) and a No Trench Configuration.

In order to quantify oil recovery contribution along the well pair, a simulation case was defined in which the production length (62) was divided into 3 equal well length zones. The zones were named according to location as Heel, Center and Toe. SAGD simulations were run for each of the No Trench and Trench configurations in order to get a sense how a trench (30) might affect gravity drainage and to quantify resulting changes in the oil recovery contribution for each zone. Referring to FIG. 10, results for the Trench configuration are represented using lines while results for the No Trench configuration are represented with symbols. It can be seen that the cumulative oil recovery difference between the No Trench configuration and Trench configuration is considerable. In the Trench configuration the biggest oil recovery was obtained from the Toe, followed by the Center, and the lowest oil recovery was obtained from the Heel. For the No Trench configuration there was considerably lower oil recovery from the Heel section while oil recovery in the Toe and Center are similar. Again the trench (30) improved accessibility to productive higher permeability layers by penetrating inter-bedded shale or other permeability barriers (86).

Figure 11:
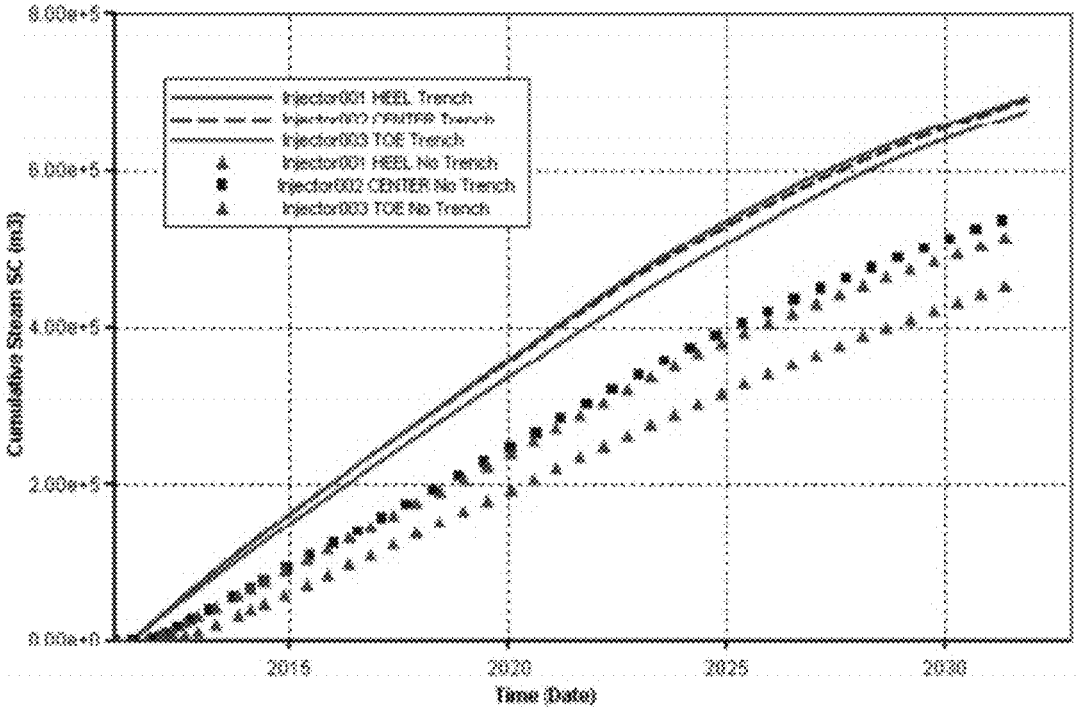
FIG. 11 is a graph of cumulative steam injection for a SAGD well pair in a heterogeneous formation as a function of time, comparing cumulative steam injection at a Heel zone, a Center zone and a Toe zone for both a Trench configuration (i.e., a system including a trench) and a No Trench configuration.

A similar exercise was conducted for the injection wellbore (70) to obtain an indication of how the steam was injected along the injection length (72). A simulation case was defined in which the injection length (72) was divided into 3 equal well length zones. As before the zones were designated as Heel, Centre and Toe. It is important to note that during this evaluation of the different zones the injection wellbore (70) was operated at the same conditions along its full length; steam was injected at a constant pressure of 2000 kPa. Referring to FIG. 11, it is clear that for the Trench configuration the cumulative steam injection is greater than that for the No Trench configuration. Also, for the Trench configuration cumulative steam injection is more uniform across zones than is the case for the No Trench Configuration. For the No Trench configuration there is a lower amount of steam taken in the Heel zone while steam injection in the Toe and Center are similar. For the Trench configuration cumulative steam injection is greatest for the Toe, followed by the Centre while the Heel received the least. This profile for steam injection across zones corresponds to the profile for cumulative oil recovery from the production wellbore (60).

Figure 12:
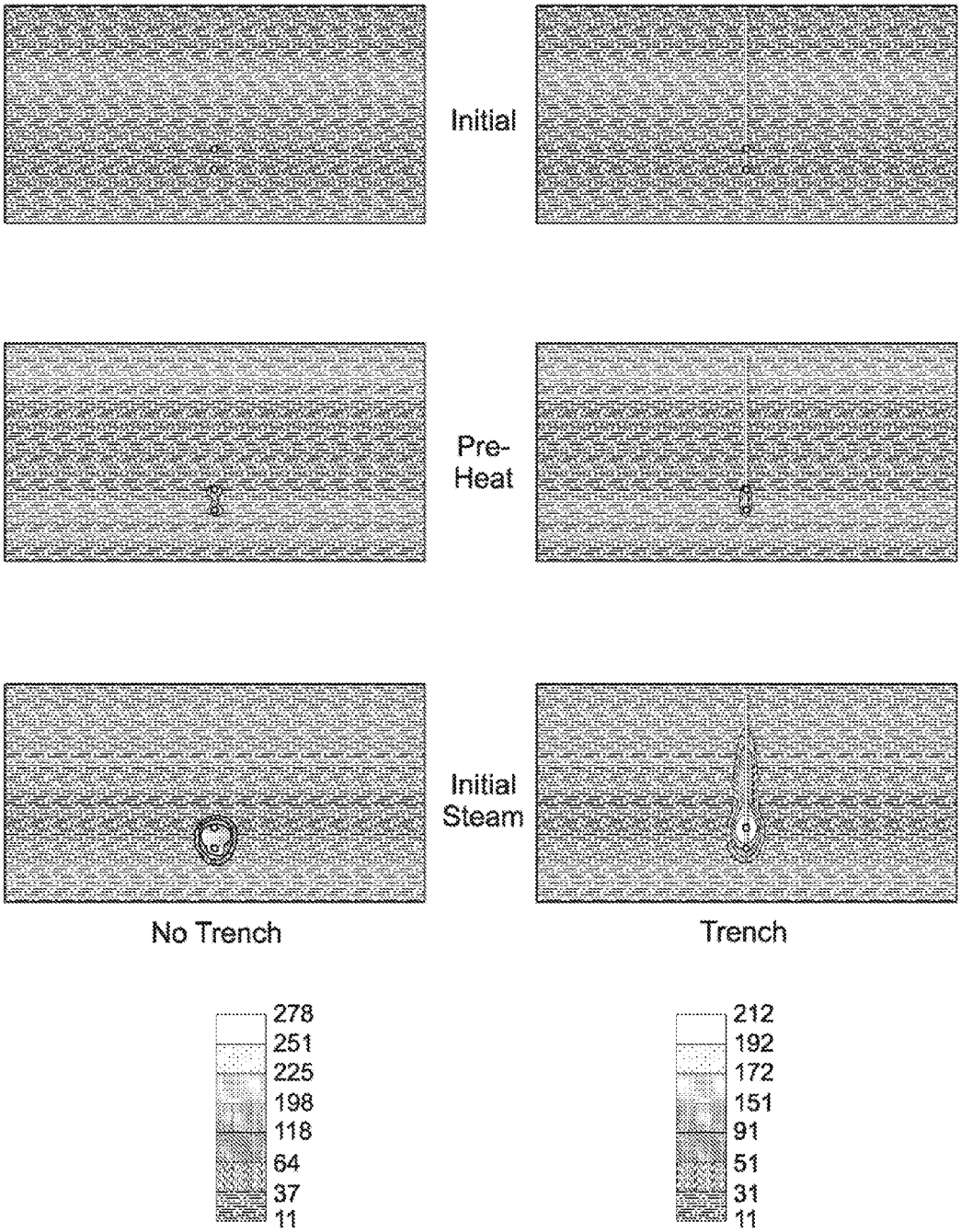
FIG. 12 is a series of graphs depicting early stage temperature distribution in the vicinity of a SAGD well pair in a heterogeneous formation for both a Trench configuration (i.e., a system including a trench) and a No Trench configuration.

FIG. 12 shows a comparison of the cross-sectional temperature distribution representative of the Centre zone of the well pair for each of the No Trench and Trench configurations. Temperature is presented for: the initial condition at native reservoir temperature; during SAGD pre-heating to establish initial communication between the injection wellbore (70) and the production wellbore (60); and at initiation of steam injection. It is noted how quickly the heat moves throughout and outward from the trench (30) as soon as the injection of steam is initiated. This provides an advantage with respect to accelerated steam chamber development but is offset somewhat by the potential for earlier heat losses to the overburden.

Figure 13:
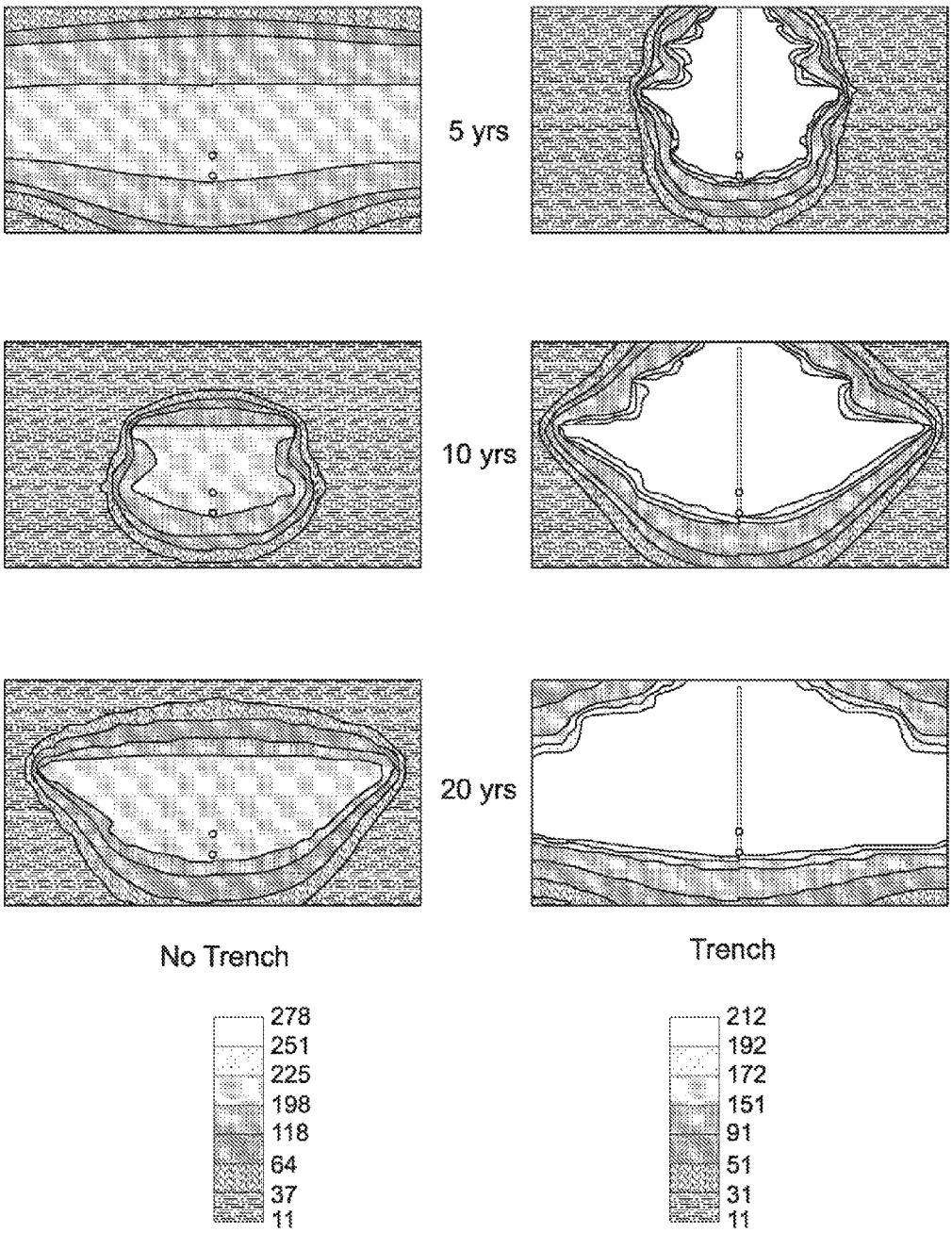
FIG. 13 is a series of graphs depicting the evolution of temperature distribution in the vicinity of a SAGD well pair in a heterogeneous formation over 5 years, 10 years and 20 years, for both a Trench configuration (i.e., a system including a trench) and a No Trench configuration.

FIG. 13 provides a comparison of the evolution of the cross-sectional temperature distribution at the Centre zone of the well pair for the No Trench and Trench configurations. Cross-sectional temperature distributions are presented after each of 5 years, 10 years and 20 years of steam injection. The Trench configuration shows an obvious benefit in terms of a significantly larger heated cross-sectional area.

It was anticipated that the benefits of the Trench configuration might decline as the average permeability of the formation increased. Therefore, as a preliminary test of this hypothesis a formation case was constructed using the same heterogeneous model except that the values of permeability were everywhere multiplied by four. All other parameters were kept the same.

Figure 14:
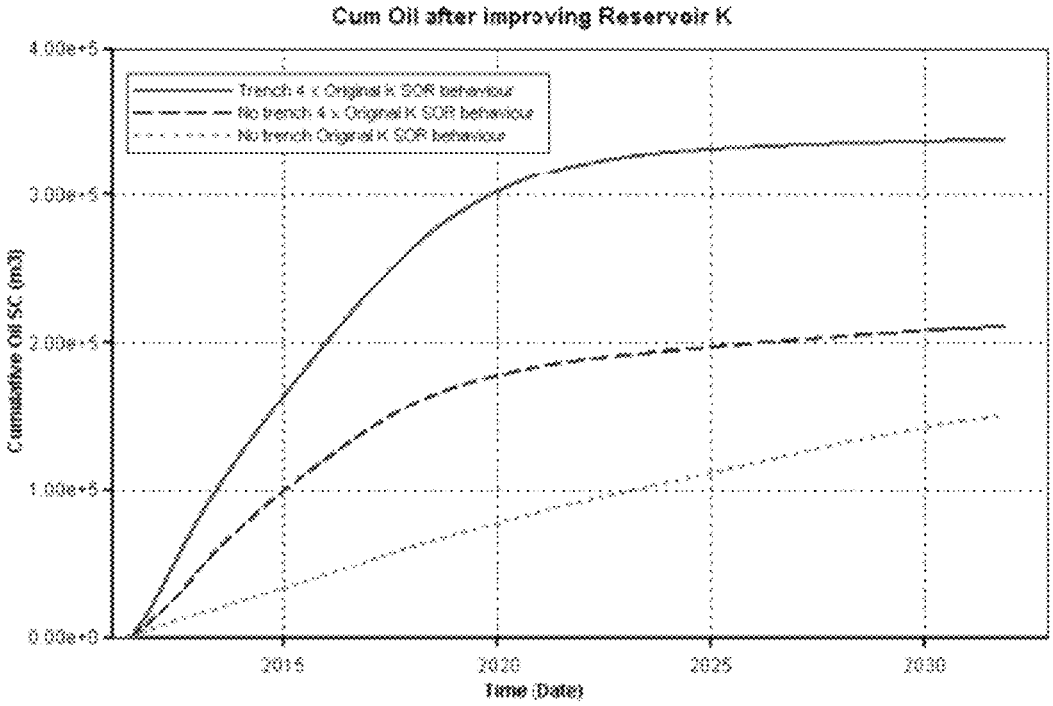
FIG. 14 is a graph of cumulative oil recovery for a SAGD well pair in a heterogeneous formation as a function of time, comparing cumulative oil recovery for a Trench configuration (i.e., a system including a trench) with enhanced formation permeability with cumulative oil recovery for a No Trench configuration with unenhanced formation permeability and cumulative oil recovery for a No Trench configuration with enhanced formation permeability.

A comparison of cumulative oil recovery is presented in FIG. 14. Ultimate oil recoveries are predicted to be 338,733 $m^3$ for the Trench configuration compared to 210,711 $m^3$ for the No Trench configuration, representing a performance improvement of 61% for the Trench configuration. This result is broadly in line with previous results for heterogeneous models. This result suggests that performance improvements, as measured by cumulative oil recovery, for the Trench configuration are not particularly sensitive to average formation permeability.

Figure 15:
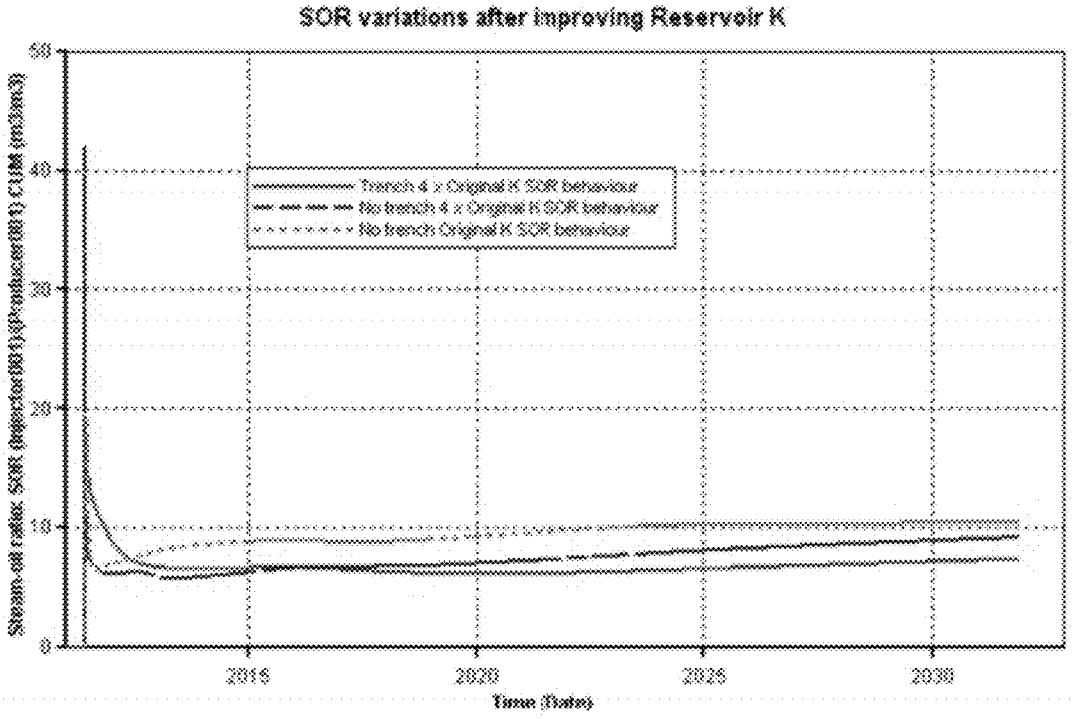
FIG. 15 is a graph of steam-oil ratio for a SAGD well pair in a heterogeneous formation as a function of time, comparing steam-oil ratio for a Trench configuration (i.e., a system including a trench) with enhanced formation permeability with cumulative oil recovery for a No Trench configuration with unenhanced formation permeability and cumulative oil recovery for a No Trench configuration with enhanced formation permeability.

FIG. 15 compares performance for the No Trench and Trench configurations in the enhanced permeability model on the basis of steam-to-oil ratio (SOR). Later in the SAGD cycle the Trench configuration provides an improvement of about 15%. However, for early production times, years 2011-12, the SOR is higher for the Trench configuration, which is probably related to rapid full-height steam chamber development and consequently early heat losses to the overburden.

In this particular formation model some of the layers have high water saturation with values ranging up to 40%. At the same time, some layers have high oil saturation. All in all, the predicted SOR's for this model formation are high (6+), even with the performance benefits of the Trench configuration. It may be fair to conclude that this is not a good candidate formation for the SAGD process.

4. Trenching Parameter Simulations (a) Partial Height Trench

Figure 16:
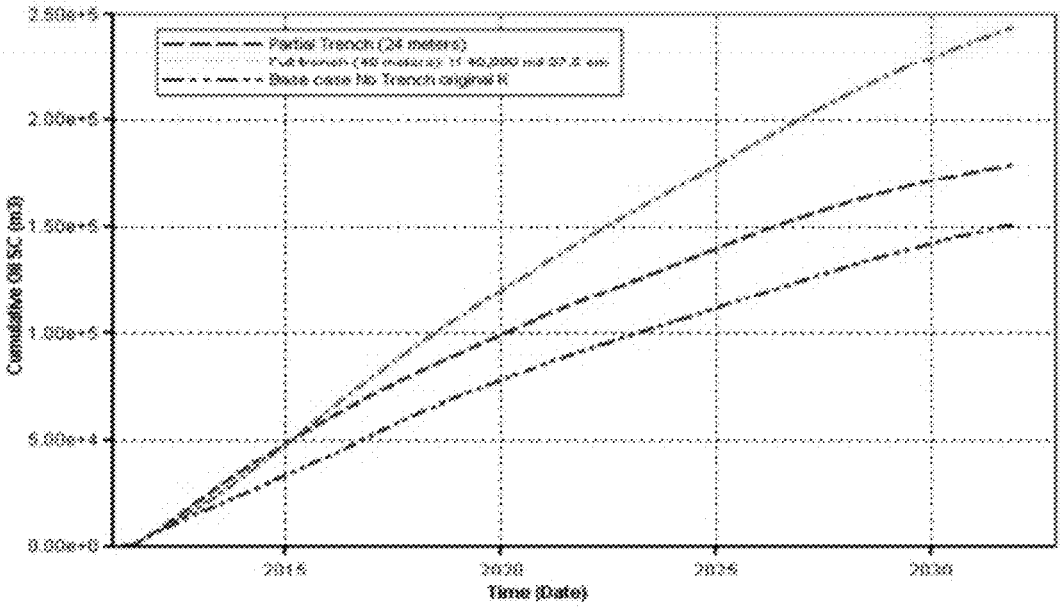
FIG. 16 is a graph of cumulative oil recovery for a SAGD well pair in a heterogeneous formation as a function of time, comparing cumulative oil recovery for a Trench configuration (i.e., a system including a trench) having a partial height trench, a Trench configuration (i.e., a system including a trench) having a full height trench, and a No Trench configuration.
Figure 17:
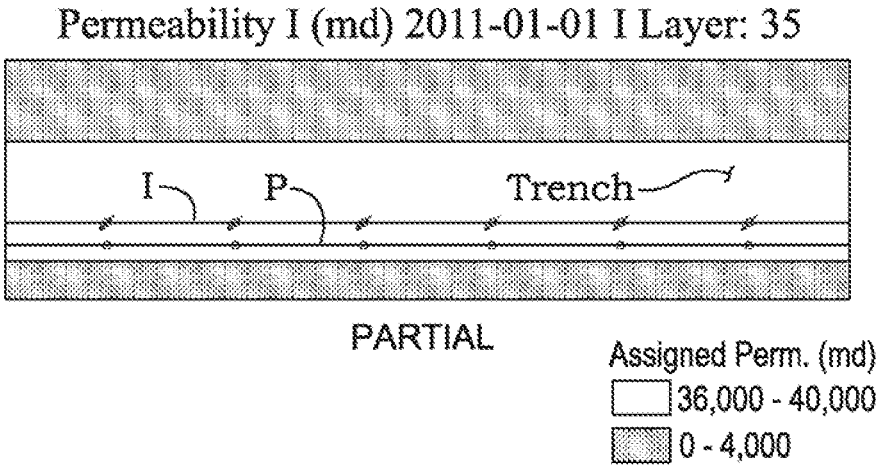
FIG. 17 is a pair of graphs providing a side elevation schematic view of the partial height trench and a side elevation schematic view of the full height trench of FIG. 17.
Figure 17:
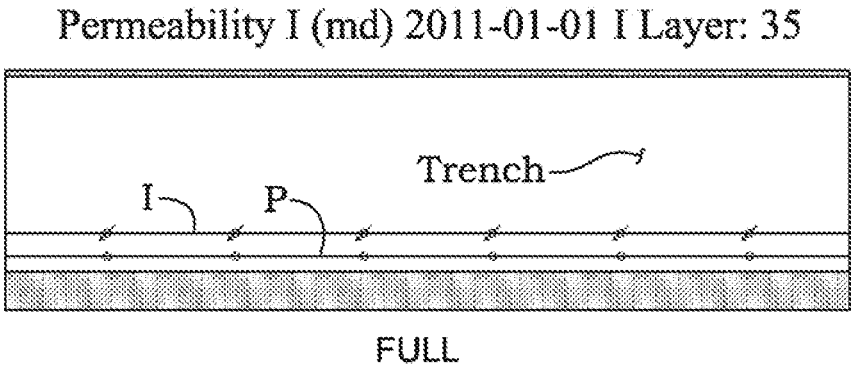

Cumulative oil recovery in the heterogeneous model appears to be more or less directly related to the total height of the trench (30). The performance improvement in the Trench configuration for implementation of a partial height (24 in high) trench (30) is less than 50% of that for a full height (40 m high) trench (30). FIG. 16 compares performance for the partial height and full height trench configurations shown in FIG. 17.

(b) Trench Width versus Permeability Trade-Offs

Figure 18:
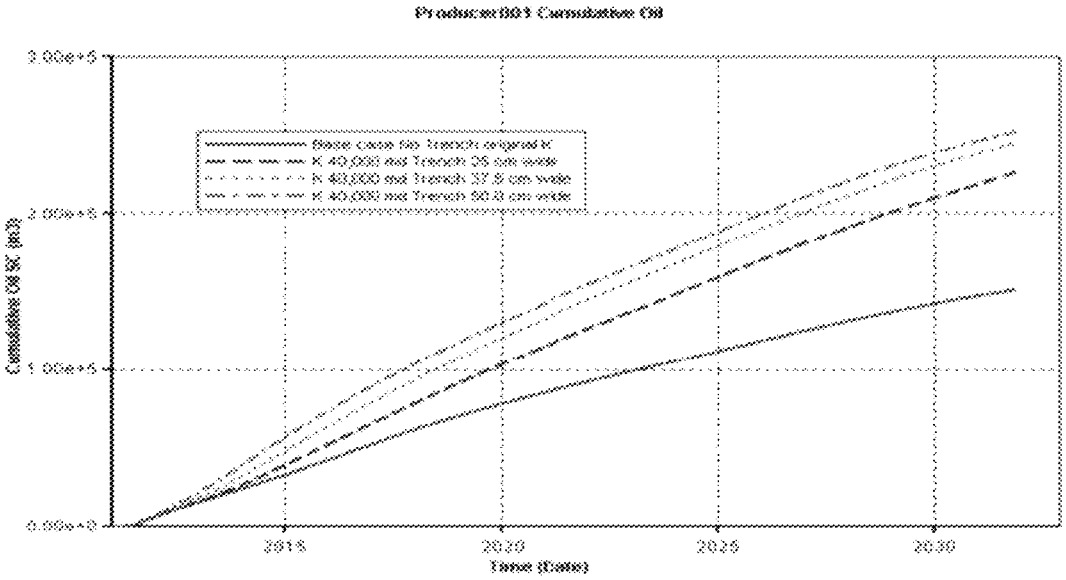
FIG. 18 is a graph of cumulative oil recovery for a SAGD well pair in a heterogeneous formation as a function of time, comparing cumulative oil recovery for Trench configurations (i.e., systems including a trench) having trench widths of 25 centimeters, 37.5 centimeters and 50 centimeters and a trench permeability of 40,000 mD, and a No Trench configuration.

FIG. 18 shows the effect of trench width (44) for a trench (30) permeability of 40,000 mD. As the trench width (44) increases from 25 cm, 37.5 cm and up to 50 cm there is an increase in cumulative oil recovery. For all Trench cases there is a significant additional cumulative oil recovery compared to the No Trench configuration.

Figure 19:
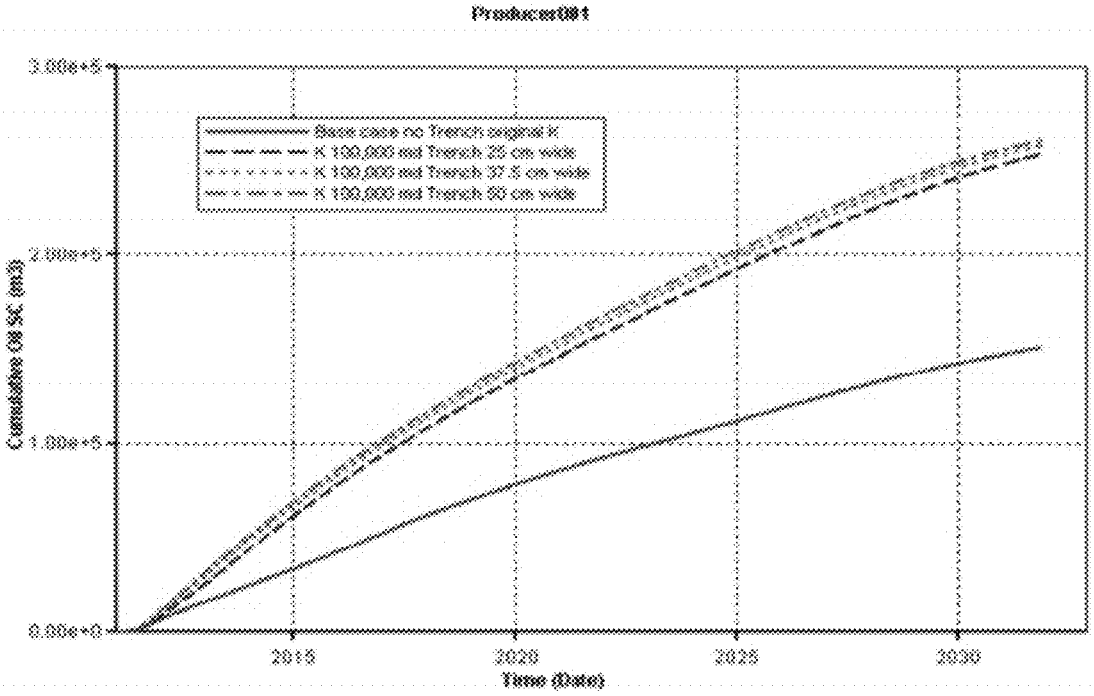
FIG. 19 is a graph of cumulative oil recovery for a SAGD well pair in a heterogeneous formation as a function of time, comparing cumulative oil recovery for Trench configurations (i.e., systems including a trench) having trench widths of 25 centimeters, 37.5 centimeters and 50 centimeters and a trench permeability of 100,000 mD, and a No Trench configuration.

Similarly, FIG. 19 shows the effect of trench width (44) for a trench (30) permeability of 100,000 mD, which is arbitrarily assumed herein to represent an upper limit for the effective permeability of a packed trench (30). As before, cumulative oil recovery increases with trench width (44) but the effect is much less pronounced compared to the case where the permeability of the trench (44) is assumed to be 40,000 mD. Above some value of permeability the trench width (44) may not be as critical. This apparent conclusion could have important cost implications: less time to cut the trench (30), less cuttings to be lifted and processed at surface, and less material required for packing of the trench (30).

For this particular case the gain in cumulative oil recovery is slightly over 100,000 $m^3$, which represents about a 70% increase relative to the No Trench configuration benchmark.

Figure 20:
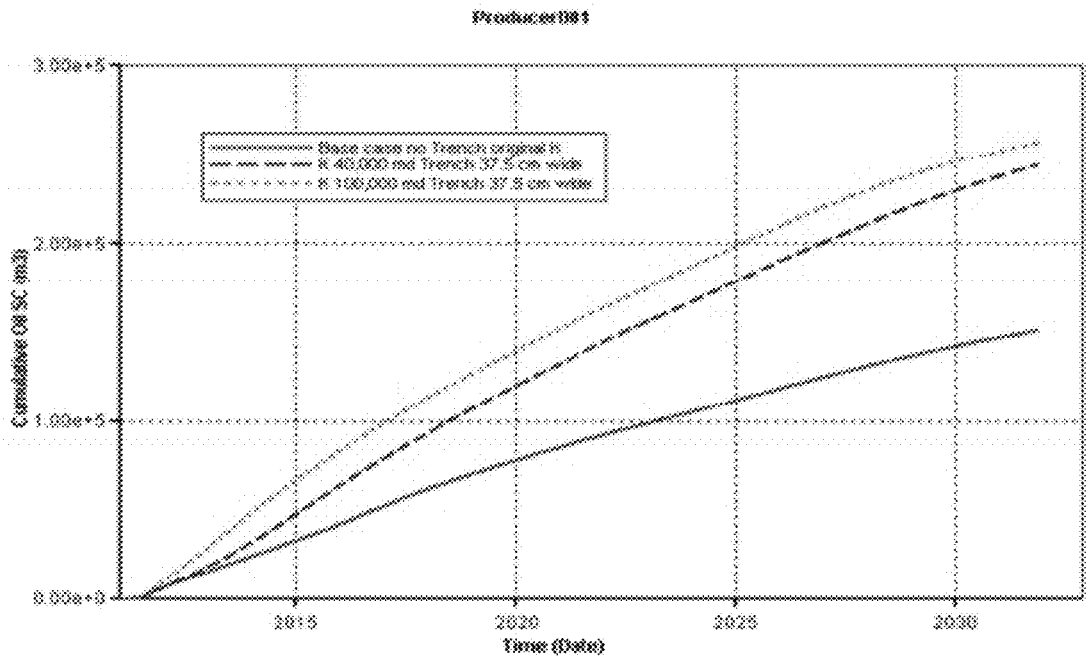
FIG. 20 is a graph of cumulative oil recovery for a SAGD well pair in a heterogeneous formation as a function of time, comparing cumulative oil recovery for a Trench configuration (i.e., a system including a trench) having a trench width of 37.5 centimeters and a trench permeability of 40,000 mD, a Trench configuration (i.e., a system including a trench) having a trench width of 37.5 centimeters and a trench permeability of 100,000 mD, and a No Trench configuration.

FIG. 20 presents a comparison of the cumulative oil recovery performance for two trenches (30) of the same trench width (30) of 37.5 cm, but with different permeabilities; 100,000 mD and 40,000 mD. For this specific formation model and trench width (30) the higher permeability packing is predicted to provide better performance.

(c) Permeability Reductions within the Trench

During the packing of the trench (30) it is possible that, due to variability in the wall stability of the different layers, some layer material of low permeability may collapse into and become part of the packing material. To assess how such low permeability bodies packed inside the trench (30) could affect the performance of the well pair some scenarios were defined and simulated.

Figure 21:
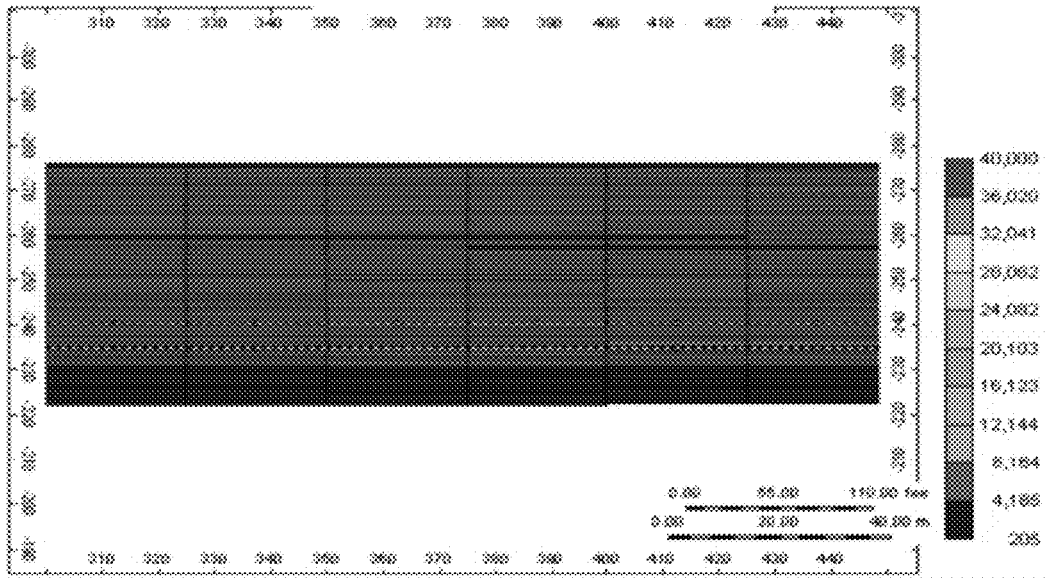
FIG. 21 is a graph providing a side elevation schematic view of a Pattern A permeability reduction along a trench length of a trench.
Figure 22:
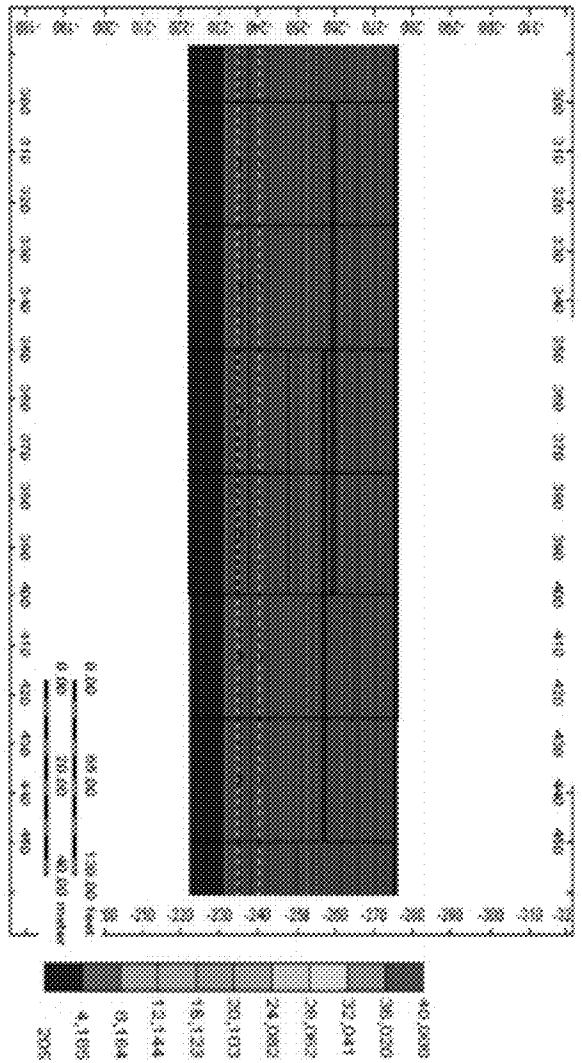
FIG. 22 is a graph providing a side elevation schematic view of a Pattern B permeability reduction along a trench length of a trench.

The base case used for the simulation was a trench (30) with a permeability of 40,000 mD, a width of 37.5 cm, a height of 40 meters, and a length of 750 meters. To evaluate the effect of the permeability reduction a set of three different permeability reduction patterns were evaluated by variously distributing 300 mD layers inside the packed trench (30). These patterns are designated Patterns A, B and C. Pattern A and Pattern B are illustrated in FIGS. 21 and 22. Pattern C is a random type of pattern with permeability reduction layers of 25 meters in length and 1 meter in thickness randomly distributed along the entire trench (30). It is believed that Pattern C probably approximates most closely the pattern which is most likely to occur in the field.

Figure 23:
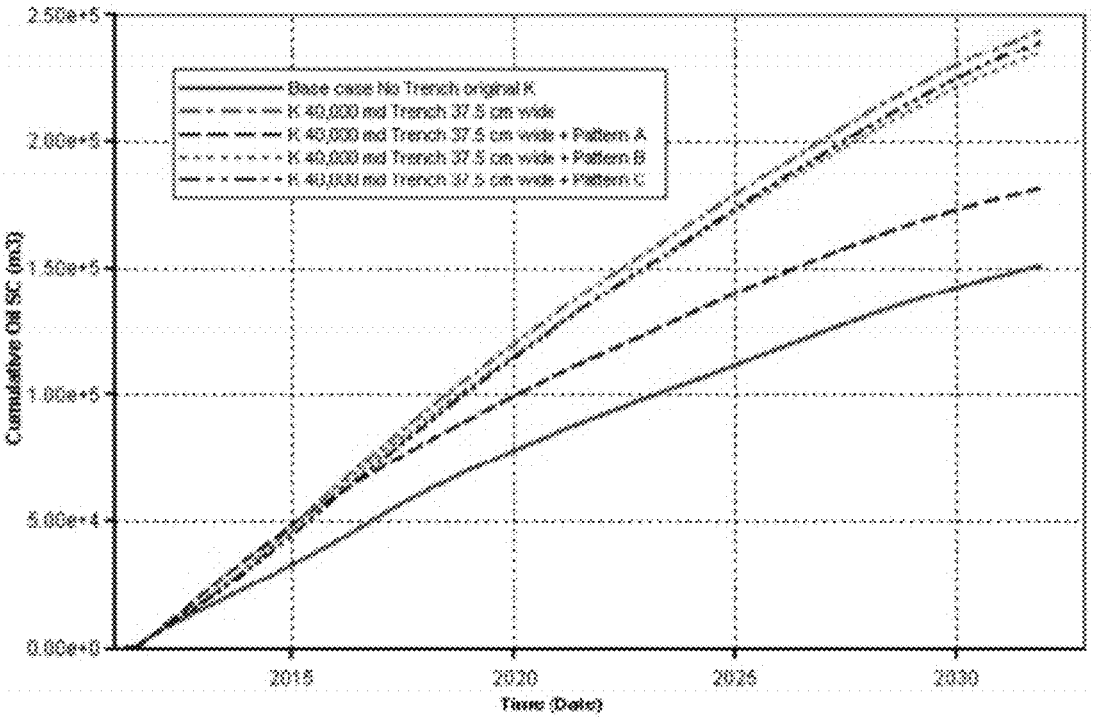
FIG. 23 is a graph of cumulative oil recovery for a SAGD well pair in a heterogeneous formation as a function of time, comparing cumulative oil recovery for four Trench configurations (i.e., systems including a trench) and one. No Trench configuration, in which each of the four Trench configurations has a trench permeability of 40,000 mD and a trench width of 37.5 centimeters, and in which the four Trench configurations include a no permeability reduction configuration, a Pattern A permeability reduction configuration, a Pattern B permeability reduction configuration, and a Pattern C permeability reduction configuration.

As expected, maximum cumulative oil recovery occurs when the trench (30) permeability is free of low permeability layers and otherwise depends upon the geometry and the continuity of the reduced permeability barriers inside the trench (30). This can be seen in FIG. 23 where Pattern A produces a marked reduction in performance. More random or scattered and discontinuous reduced permeability barriers in the trench (86) do not have as great a negative impact on well performance as continuous reduced permeability barriers.

From these results it can be concluded that during the construction of the trench (30) it is very important to have both a stable open trench (30) with good mud control in cases of poor wall stability and a good high permeability pack. Scattered bodies of low permeability have some minor effect, which could likely be minimized by constructing a wider trench (30) and/or by using a higher permeability packing material in the trench (30).

(d) Different Trench Well Pair Configurations

Figure 24:
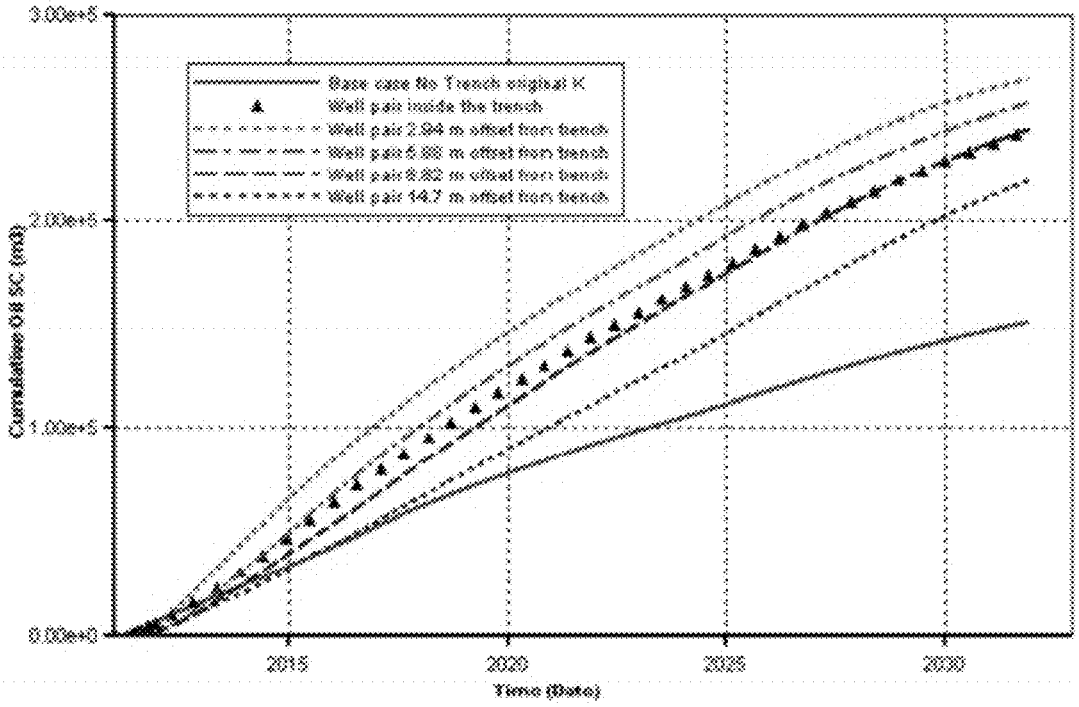
FIG. 24 is a graph of cumulative oil recovery for a SAGD well pair in a heterogeneous formation as a function of time, comparing cumulative oil recovery for five Trench configurations (i.e., systems including a trench) and one No Trench configuration, in which the Trench configurations include variations in the location of the well pair relative to the trench.

Referring to FIG. 24, an assessment was performed to evaluate the effect on cumulative oil recovery when the SAGD well pair was not placed inside the trench (30) but at some offset from the trench (30) horizontally. The vertical distance between the injection length (72) and the production length (62) was kept equal to 5 meters in all cases. The horizontal offset between the SAGD well pair and the trench (30) was set at 2.94 meters, 5.88 meters, 8.82 meters or 14.7 meters.

It is noted that by placing the well pair outside the trench (30) it may be possible to gain additional cumulative oil recovery. The maximum cumulative oil recovery was obtained for an offset of 2.94 meters, which shows an increase of cumulative oil of 24,108 $m^3$ (267,926 $m^3$-243,818 $m^3$) with respect to the case where the well pair is inside the trench (30).

Placing the SAGD well pair outside the trench (30) could introduce some new opportunities for trench construction and trench packing. One case of particular interest would be to place only the injection length (72) outside the trench (30) while the production length (62) is placed inside and at the bottom of the trench (30). This configuration would allow the trench (30) to be constructed from the production length (62) while avoiding complications associated with landing an injection liner in or on a packing material in the trench (30).

Figure 25:
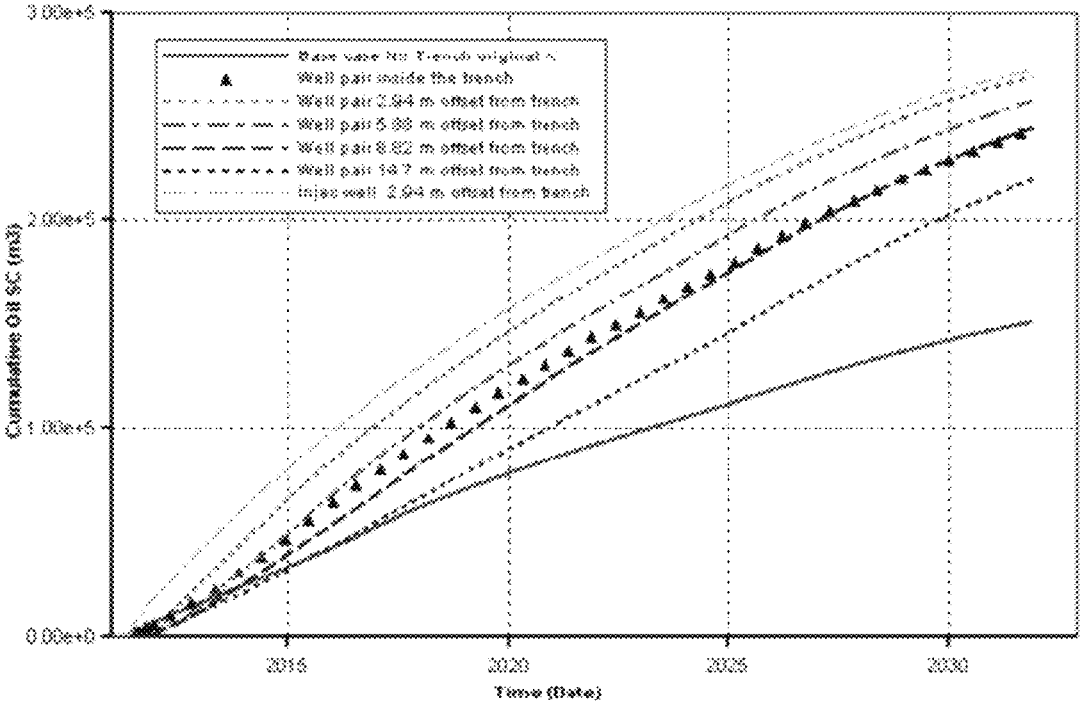
FIG. 25 is a graph of cumulative oil recovery for a SAGD well pair in a heterogeneous formation as a function of time, comparing cumulative oil recovery for six Trench configurations (i.e., systems including a trench) and one No Trench configuration, in which the six Trench configurations include variations in the location of the well pair or the location of the injection length relative to the trench.

Interestingly, placing the injection length (72) outside the trench (30) at a 2.94 meter offset may improve the cumulative oil recovery of the system (20). Referring to FIG. 25, cumulative oil recovery from early times is better and is maintained, although gradually declining, to the end of the forecast. Further investigation may be required to verify and explain this finding. One possible explanation is that by forcing the injected steam to pass through the native porous media before entering the higher permeability trench (30) both injected steam distribution and heat loss control are improved.

Trench Design Considerations

The trench-making concepts presented herein presume that the system (20) is to be implemented as an enhancement to a SAGD type process that uses a production length (62) and an injection length (72) as a horizontal well pair. Therefore, it is assumed that either of these wellbore lengths (62,72) may be used as an access conduit from which to build a trench (30) such that the costs of an additional cased hole to surface may be avoided.

1. Performance Factors

As originally conceived, a high permeability trench (30) was intended to address formation heterogeneity and its negative impacts on the performance and predictability of recovery processes such as SAGD. This conceptualization presumes a design context presenting only a coarse resolution mapping of variations in average permeability throughout the target formation and very little if any knowledge about the specific location or extent of discrete low permeability barriers. Intuitively then, the trench (30) should ideally provide a flow pathway that meets the following criteria:

(a) accommodates counter current flow of injected steam and produced liquids;

(b) exhibits predictable permeability, preferable high, over its operating life;

(c) is closely coupled to the production length (62) and the injection length (72);

(d) accesses substantially the full formation thickness (28); and (e) accesses substantially the entire length of the production length (62) and the injection length (72).

The simulation studies have explored these intuitive criteria and have provided the basis for design considerations of a system (20) according to the invention. Further discussion of these design considerations follows.

(a) Trench to Accommodate Counter Current Flow

During SAGD operation the trench (30) may be required to accommodate counter current flow past impermeable barriers—upward flow of steam from the injection length (72) and downward flow of produced liquids to the production length (62). This suggests that the trench (30) must provide some minimum flow cross sectional area averaged along the length of the SAGD well pair. Although the simulation studies suggested that the trench (30) need not be continuous along the well pair it may prove very difficult to pack many discrete trench sections (90) which are constructed in an upward direction from a common horizontal access well. Therefore, it may be more feasible and effective to provide a more or less uninterrupted trench (30) which is everywhere sufficiently wide to accommodate counter current flow.

Figure 26:
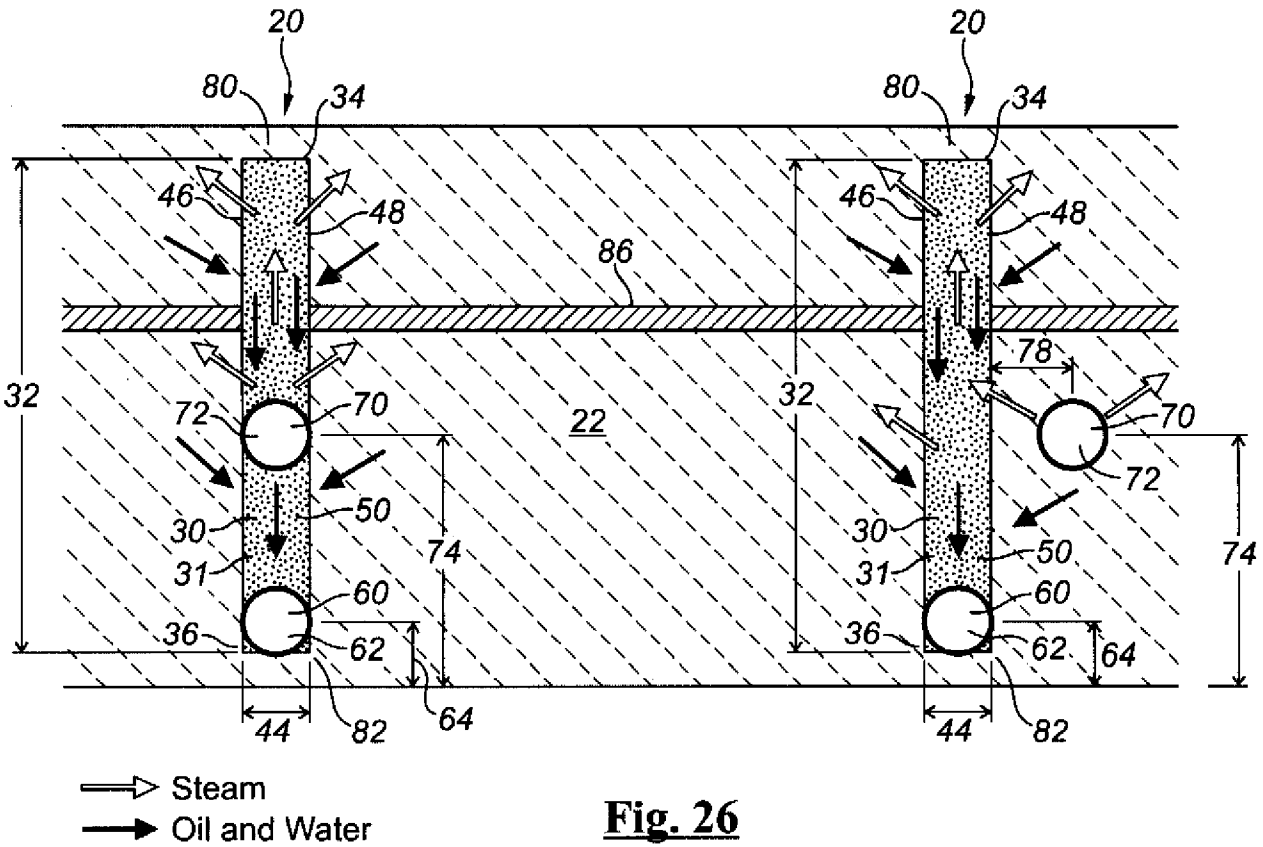
FIG. 26 is a pair of schematic views of anticipated flow paths through a formation having a permeability barrier, for a system configuration in which both the production length and the injection length are located in the trench and for a system configuration in which the production length is located in the trench and the injection length is offset laterally from the trench.

FIG. 26 provides a schematic representation of likely counter current flow patterns, which include a constriction at the permeability barrier (86).

(b) Permeability within the Trench Over SAGD Operating Life

Predictable (high) permeability at all locations within the trench (30) may possibly only be achieved by packing the trench (30) with a sand and/or gravel of controlled permeability. In the absence of a pack it is expected that the trench (30) may collapse, probably early during SAGD operations, as bitumen is produced into and through the trench (30). Collapse of the trench (30) may yield unpredictable permeability variations within the sloughed-in trench (30), although the resulting average permeability of the trench (30) may continue to be higher than the native permeability of the formation (22).

Expanding the trench width (44) in order to increase the cross sectional area of the high permeability flow channel may be effective in offsetting the negative effects of lower average permeability within a sloughed-in trench (30). However, as the trench width (44) expands, the volume of cuttings and all commensurate costs increase. Also, it may prove difficult to construct a trench (30) that is significantly wider than the diameter of the access well from which it is constructed. Assuming that either the SAGD production wellbore (60) or injection wellbore (70) is used for constructing the trench (30) this may limit the effective trench width (44) to about 30 centimeters.

(c) Flow Coupling of Trench to Production Length and Injection Length

Assuming that the trench (30) is constructed from either the production length (62) or the injection length (72), at least one of these lengths (62,72) will be located in the trench (30). Alternatively, the trench (30) could be constructed from a horizontal well that is side-tracked from and runs parallel to either the production length (62) or the injection length (72). In this later case both the production length (62) and the injection length (72) could be offset horizontally from the trench (30). As discussed above, FIGS. 1A-1D and FIGS. 2A-2C provide schematic representation of various trench (30) and well pair configurations.

The most direct and quickest approach for establishing flow communication amongst the trench (30), the production length (62) and the injection length (72) is to locate both of the production length (62) and the injection length (72) within the trench (30). This approach would require that the trench (30) be packed, at least to the level of the bottom of the injection liner (102), where an injection liner (102) is provided, in order to support the injection liner (102) in the trench (30).

On the other hand, the simulation studies discussed above suggest that there may be an advantage in terms of lower SOR if the injection length (72) is offset laterally from the trench (30) by the injection offset distance (78). A further consideration in favour of offsetting the injection length (72) laterally from the trench (30) is that it may be difficult to drill into or otherwise land an injection liner (102) in the packed trench (30). This would almost certainly be the case if it was difficult to control the alignment or width of the trench (30).

Where the production length (62) and/or the injection length (72) are offset from the trench (30) it may be advantageous to limit the production offset distance (76) and/or the injection offset distance (78) in order to speed the development of flow communication between the offset well and the trench (30).

In this configuration packing of the trench (30), at least to the level of the offset injection length (72), may be advisable in order to prevent sloughing-in of the trench (30) and destabilization of the injection length (72).

(d) Vertical Positioning and Extent of the Trench

The simulation studies suggest that a large extent of the benefits of a trench (30) may result from creating flow pathways through permeability barriers (86) in the formation (22). Therefore, in circumstances where the elevation and thickness of permeability barriers (86) are precisely known it might be feasible, at least theoretically, to position and size the height of a trench (30) to do no more than span the known permeability barriers (86). However, there are offsetting considerations that may make this approach infeasible. First, the location of all major permeability barriers (86) is usually not known or practically determinable. Second, unless the trench (30) is constructed from the production length (62) or the injection length (72), an additional side-tracked horizontal well will be required for construction of the trench (30), which would add to the cost of constructing the system (20) of the invention.

It is noted that the simulation studies do not directly account for all the possible causes of non-uniform steam chamber development over the length of the well pair, nor how such might be alleviated by a trench (30). For example, the simulation studies assume uniform steam delivery all along the injection length (72) and uniform reservoir temperature all along the well pair at the end of the SAGD initialization stage. However, the simulations using a heterogeneous reservoir model indicate that a full height, high permeability trench (30) may increase cumulative oil recovery and may increase the uniformity of steam chamber development along the well pair.

A further consideration that impacts the decision on where to locate the top of the trench (30) is early and accelerated heat loss to the overburden. To limit such heat loss it may be preferable to stop the trench (30) several meters below the top of the formation (22). Further simulation studies may provide useful quantification of the expected trade-offs between leaving stranded oil above a permeability barrier (86) located high in the formation (22) and accelerated heat loss from a trench (30) that extends all the way to the upper formation boundary (24). Currently, it is theorized that it may be advantageous to provide an upper boundary distance (80) of no less than about 3 meters.

(e) Longitudinal Continuity of the Trench

It is possible that a series of discrete slots or holes aligned along and offset laterally from a SAGD well pair, provided that they are sufficiently large and not too widely spaced apart, could provide some of the performance enhancement offered by a continuous trench (30). The motivation to use a series of discrete slots or holes instead of a continuous trench (30) would be to reduce cuttings and thereby trench-making costs. Although the system (20) of the invention could possibly be implemented using a series of discrete slots or holes in place of a continuous trench (30), it may be difficult to reliably pack such slots or holes. One potentially feasible option in this regard may be to fill the discrete slots or holes from the bottom up with buoyant proppant sand.

2. Trench Stability

The stability of the walls of the trench (30) must be maintained during construction to prevent premature collapse, i.e. before the installation of liners and before packing of the trench is completed. It is believed that the required stability can be achieved, for at least the following reasons.

First, techniques for successfully drilling the horizontal sections of SAGD well pairs are already proven, in which open hole stability is maintained by selecting an appropriate drilling fluid, one that is compatible with the clays encountered, and by balancing pore pressure. We expect that similar drilling fluid selection and pressure balancing techniques will provide a stable trench (30) opening.

Second, field trials on slurry mining of oil sand conducted by Imperial Oil at Cold Lake in 1990 and 1991 have demonstrated that an approximately vertical oil sand face maintained in a submerged condition could be stable over a period of months (see Sharpe, J. A., Shinde, S. B., Wong, R. C., 1997, Cold Lake Borehole Mining, The Journal of Canadian Petroleum Technology; January 1997, Volume 36, No. 1; and Wong, Ron C. K., 1996, Behaviour of Water-Jet Mined Caverns in Oil Sand and Shale, Canadian Geotechnical Journal, 33, 610-616), 3. Potential Trench-making Cost Drivers (a) Avoiding Additional Wells If possible, construction of a trench (30) should avoid the need to drill and complete new access wells from surface or even to drill new side-tracks from existing wells. As a result, it may be preferable that the production wellbore (60) or injection wellbore (70) be used for construction of the trench (30) and that the production length (62) and/or the injection length (72) be incorporated into the trench (30).

(b) Minimizing Rig Time

As with well drilling, total rig time is likely to be a major driver of total costs for trench construction. This means that the trench construction approach should minimize both the required productive rig time and the probability for non-productive rig time. In turn, this drives a focus on the desirability of:

(i) rapid trench cutting rates;

(ii) minimized mechanical failure rates; and (iii) minimized probability for stuck tooling.

(c) Handling and Disposing of Cuttings

The volume of cuttings from a 30 centimeter wide by 15 meter high continuous trench is about 64 times greater that the volume of cuttings from a 30 centimeter diameter SAGD production wellbore (60) or injection wellbore (70). Therefore, it may be desirable to minimize the volume of cuttings produced during construction of the trench (30), particularly because the approaches traditionally used for disposal of SAGD well cuttings may not make economic sense for cuttings from trench (30) construction.

On the other hand, recovery of bitumen from trench (30) cuttings may be a viable option, especially where jet cutting (slurrying) may precondition the cuttings to aid subsequent bitumen separation and recovery.

The trench (30) may be constructed in any suitable manner. A description of potentially suitable techniques for use in constructing the trench (30) follows.

Methods for Constructing a Trench Section, a Trench and a System

Trench cutting tools based upon mechanical cutters (drill bits or miniaturized tunnel boring machines), water jet cutting (borehole slurry mining), or other technologies may potentially be used to construct the trench (30) for the system (20) of the invention.

The trench (30) may be comprised of one or more trench sections (90). The invention includes methods for constructing a trench section (90), methods for constructing a trench (30) comprising one or more trench sections (90), and methods for constructing a system (20) comprising a trench (30).

Figure 27:
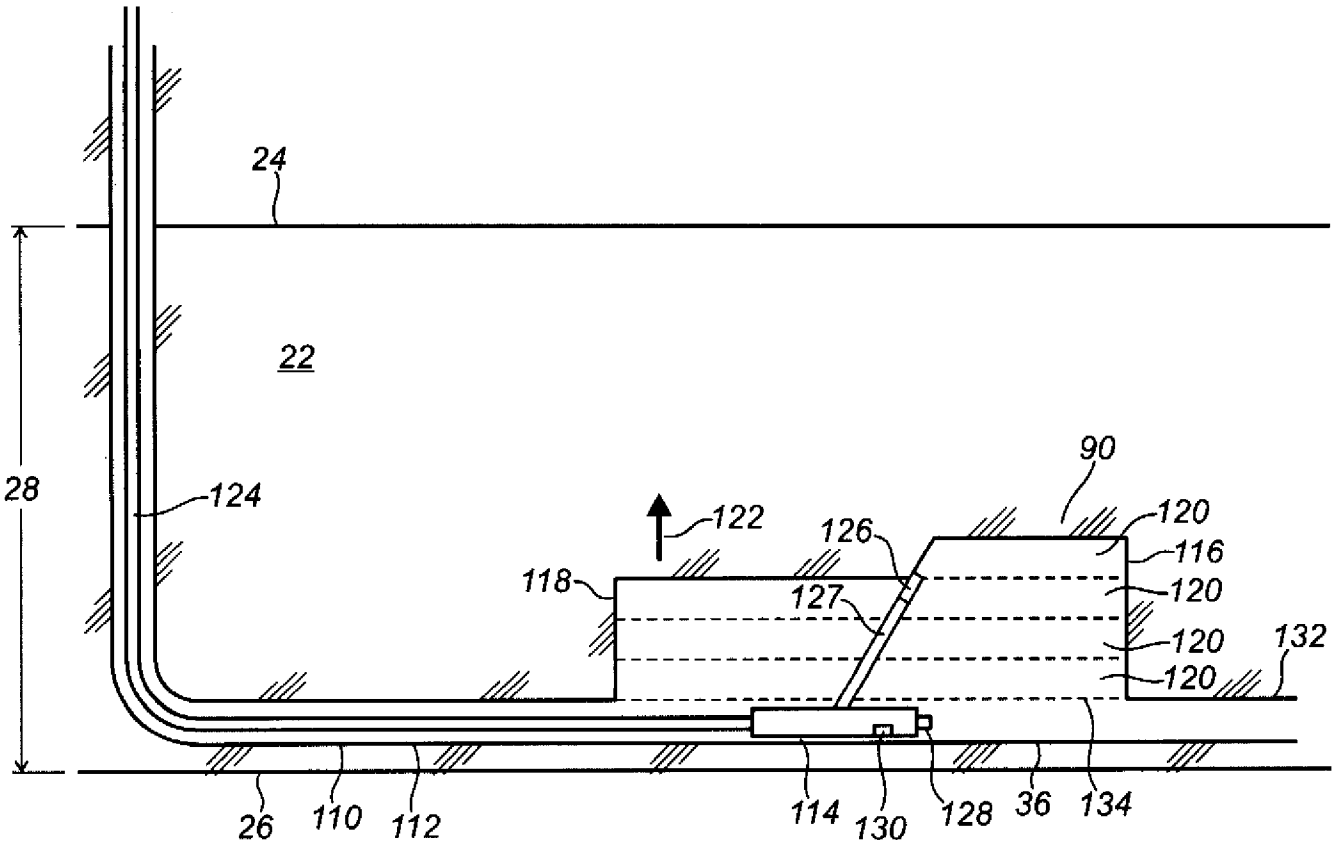
FIG. 27 is a schematic drawing of an exemplary embodiment of a method for constructing a trench section according to the invention.

Referring to FIG. 27, an exemplary embodiment of a method of the invention comprises the following procedure for constructing a trench section (90):

(a) providing within the formation (22) an access wellbore (110) comprising a substantially horizontal access wellbore length (112);

(b) introducing a trench cutting tool (114) into the access wellbore (110); and (c) repeatedly advancing the trench cutting tool (114) through the access wellbore (110) to a position which defines a distal trench section end (116) and then retracting the trench cutting tool (114) through the access wellbore (110) to a position which defines a proximal trench section end (118) while cutting a slot (120) in the formation (22) from the access wellbore (110) with the trench cutting tool (114) in a trench direction (122) away from the access wellbore (110), until a number of slots (120) required to complete the trench section (90) has been cut.

In the exemplary embodiment depicted in FIG. 27, the method may further comprise constructing a plurality of trench sections (90) in order to construct a trench (30) comprising more than one trench section (90).

In the exemplary embodiment depicted in FIG. 27, the trench cutting tool (114) is connected with a pipe string (124) such as jointed tubing or coiled tubing so that the trench cutting tool (114) can be deployed in the access wellbore (110) and advanced and retracted within the access wellbore (110).

In the exemplary embodiment depicted in FIG. 27, the trench cutting tool (114) is a water jet cutting tool which comprises a water jet cutting device (126), so that the slots (120) are cut by the water jet cutting device (126). The expected advantages of a water jet cutting tool in comparison with a mechanical cutter may be attributed to the large volume of cuttings required to construct the trench section (90), the potential abrasive wear caused by such cuttings, and the tooling size restrictions imposed by using the access wellbore (110) as access to construct the trench section (90).

The trench section (90) is thus formed by cutting a sequence of overlapping slots (120) in the trench direction (122) while raising the height of the water jet cutting device (126) on each pass. In the exemplary embodiment depicted in FIG. 27, the water jet cutting device (126) is carried on a movable boom (127) which can be raised and lowered in order to facilitate the raising of the water jet cutting device (126).

In the exemplary embodiment depicted in FIG. 27, the method for constructing a trench section (90) further comprises removing debris (not shown) from the access wellbore (110). The debris may accumulate in the access wellbore (110) as a result of the cutting of the slots (120).

In the exemplary embodiment depicted in FIG. 27, removing debris from the access wellbore (110) is comprised of flushing the debris from the access wellbore (110) with the trench cutting tool (114). More particularly, the trench cutting tool (114) is comprised of one or more cleanout jets (128) which are operated as the trench cutting tool (114) advances through the access wellbore (110) toward the distal trench section end (116), and the trench cutting tool (114) is further comprised of a jet pump (130) for circulating the debris through the access wellbore (110) to the ground surface (not shown).

In the exemplary embodiment depicted in FIG. 27, debris is removed from the access wellbore (110) after each of the slots (120) has been cut as the trench cutting tool (114) advances through the access wellbore (110) toward the distal trench section end (116) in order to cut the next slot (120).

The access wellbore (110) forms the bottom of the trench section (90) and provides both stable alignment and reliable access during construction of the trench section (90). The access wellbore (110) must therefore accommodate multiple advancing/retracting cycles of the trench cutting tool (110).

As a result, in the exemplary embodiment depicted in FIG. 27, the access wellbore (110) contains a sacrificial liner (132), and the method may further comprise installing the sacrificial liner (132) in the access wellbore (110) before cutting the slots (120). The sacrificial liner (132) is deformable, and the method further comprises forming an opening (134) in the sacrificial liner (132) in the trench direction (122) between the distal trench section end (116) and the proximal trench section end (118) before cutting the slots (120). More particularly, in the exemplary embodiment depicted in FIG. 27, the sacrificial liner (120) may be deformed to provide a U-shaped liner, as described below with reference to FIG. 32.

In the exemplary embodiment depicted in FIG. 27, the method further comprises packing the trench section (90) with a relatively permeable material (31) comprising an unconsolidated material such as sand or fine gravel of the type typically used in wells for gravel packing applications. In the exemplary embodiment depicted in FIG. 27, packing the trench section (90) comprises injecting into the trench section (90) a slurry (136) containing the unconsolidated material.

As previously discussed with respect to the system (20) of the invention, at least a portion of the production length (62) of the production wellbore (60) and/or the injection length (72) of the injection wellbore (70) may be located within the trench (30). As a result, in the exemplary embodiment depicted in FIG. 27, the method may further comprise installing the production liner (100) in the access wellbore (110) or in the trench section (90) after the trench section (90) has been completed, and/or the method may further comprise installing the injection liner (102) in the access wellbore (110) or in the trench section (90) after the trench section (90) has been completed.

With respect to water jet cutting applied to an oil sands formation, the reported results from field testing of borehole mining at Cold Lake by imperial Oil are potentially relevant (see Sharpe, J. A., Shinde, S. B., Wong, R. C., 1997, Cold Lake Borehole Mining, The Journal of Canadian Petroleum Technology; January 1997, Volume 36, No. 1). In this work the formation was accessed from a vertical well into which a rotatable jetting tool was lowered that deployed horizontally oriented cutting jets to excavate a vertical cylindrical cavity. Slurried oil sand was circulated to surface, i.e. slurry was not pumped.

Water jet cutting tools are also used to drill small diameter nominally horizontal holes from vertical wells. The typical application is re-completion of depleted oil wells and aims to break through near wellbore damage to access and produce residual oil. Usually these water jet cutting/drilling systems are delivered on coiled tubing.

1. Providing a SAGD Production Wellbore as the Access Wellbore

In this embodiment, the production length (62) of a SAGD production wellbore (60) defines the bottom of the trench (30) and provides access for the trenching operations.

Figure 28:
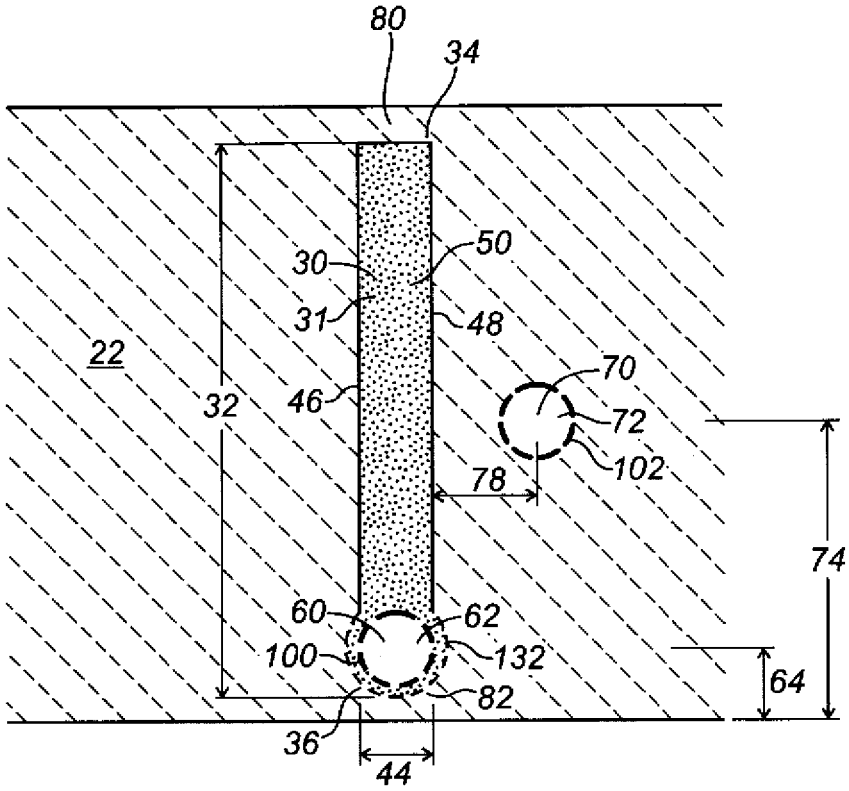
FIG. 28 is a schematic transverse cross section view of the finished configuration of a system constructed using the exemplary embodiment of the method depicted in FIG. 28.

In this embodiment, the injection length (72) of the SAGD injection wellbore (70) may be offset laterally from the trench (30) and may be drilled conventionally to avoid special provisions for drilling into or otherwise landing the injection liner (102) in the trench (30). FIG. 28 depicts a schematic cross section view of the finished configuration of the system (20) according to this embodiment.

In this embodiment, the general sequence for constructing the system (20) is as follows:

1. provide or drill the SAGD production wellbore (60) as the access wellbore (110);
2. provide or install the sacrificial liner (132) in the production wellbore (60);
3. form the opening (134) in the sacrificial liner (132) in the trench direction (122);
4. excavate the trench (30) from the bottom up as one or more trench sections (90) using the trench cutting tool (114);
5. install the production liner (100) inside the sacrificial liner (132);
6. pack the trench (30) with the relatively permeable material (31) by injecting the slurry (136) at the top of the trench (30) at the distal trench end (40); and
7. provide or drill the SAGD injection wellbore (70); and
8. provide or install the injection liner (102) in the injection wellbore (70).

Preferably, the same drilling rig may be used for constructing the entire system, including the production wellbore (60), the trench (30) and the injection wellbore (70), implying that the drilling rig is preferably a hybrid rig that is equipped to handle either jointed pipe or coiled tubing and is capable of SAGD liner installation.

2. Details of Trench Cutting Tool

Figure 29:
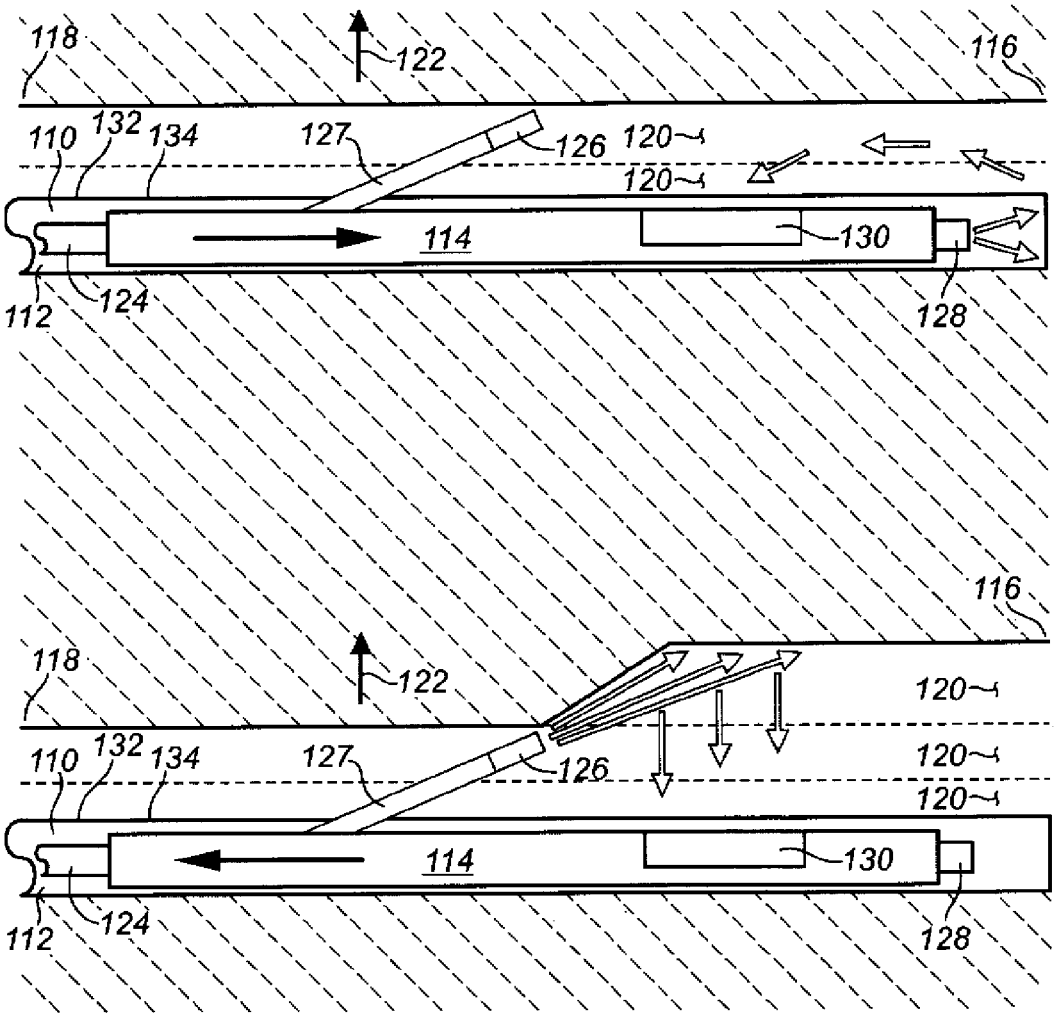
FIG. 29 is a schematic side view of a trench cutting tool advancing through a wellbore and a schematic side view of a trench cutting tool retracting through the wellbore in accordance with the exemplary embodiment of the method depicted in FIG. 28.

FIG. 29 presents a schematic view of the trench cutting tool (114) in operation. The trench cutting tool (114) is deployed through the access wellbore (110) and the deformed sacrificial liner (132) on a pipe string such as coiled tubing, and is first advanced to the distal trench section end (116) while performing a clean-out of the sacrificial liner (132) using the cleanout jets (128). The trench cutting tool (114) then cuts a continuous slot (120) in the trench direction (122), which is typically vertically upward, while being retracted back toward the proximal trench section end (118). This advancing/retracting sequence is repeated until the trench section (90) is completed (i.e., has reached the design trench height (32)).

As depicted in FIG. 29, the trench cutting tool (114) includes:

(a) a coiled tubing delivery system that may use concentric tubing and/or a separate high pressure hose to handle forward liquid flows and return slurry flows;

(b) a main body which is designed to run in and orient itself relative to the sacrificial liner (132) in order to direct the nozzle or nozzles of the water jet cutting device (126) in the trench direction (122);

(c) a jet pump to lift both slurried cuttings and debris through the access wellbore (110) to the ground surface;

(d) an erectable and retractable boom (127) for carrying the water jet cutting device (126), wherein the boom (127) can be raised and lowered to control the stand-off distance of the water jet cutting device (126) from the roof of the trench section (90) as the roof level advances upward;

(e) a power fluid control (flow splitting) system to direct flow to the water jet cutting device (126), the cleanout jets (128) and the jet pump (130), as required;

(f) an alignment system to orient the water jet cutting device (126) to cut in the trench direction (122) as the trench excavation advances upward;

(g) a measurement while trenching system to log the height, inclination and width of the trench section (90) as it is constructed.

Figure 30:
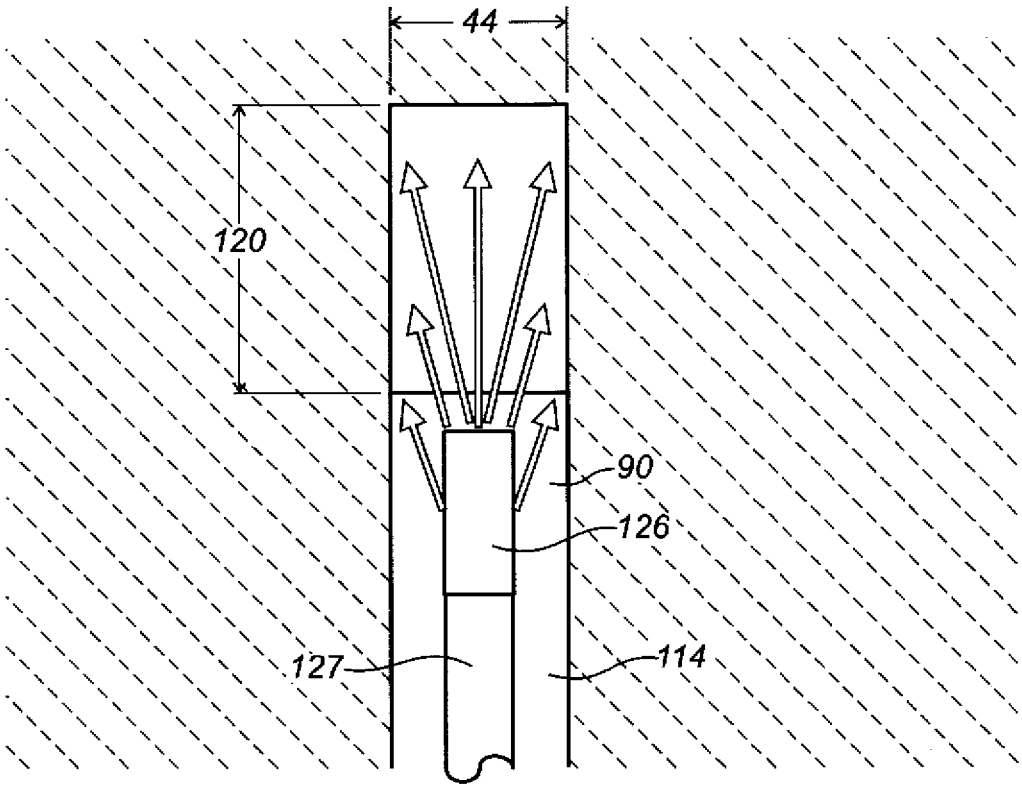
FIG. 30 is a schematic view of a water jet cutting device cutting a slot, demonstrating the depth of cut and the width of cut provided by the water jet cutting device.

FIG. 30 illustrates schematically how a water jet cutting device (126) having a small diameter rotating nozzle incorporating multiple discrete cutting jets could be used to make an approximately rectangular vertical cut of a defined width by controlling the depth of cut, so that for a given nozzle design, the trench width (44) is controlled by depth of cut per slot (120).

When the trench (30) has been excavated to its design trench height (32) and trench length (38) and debris has been removed from the sacrificial liner (132) for the last time, the trench cutting tool (114) is removed and the production liner (100) is installed inside the sacrificial liner (132).

In the exemplary embodiment, the production liner (100) incorporates a packing shoe (140) at its distal end that is designed to run in and orient itself relative to the sacrificial liner (132) such that a packing tube (142) may be directed vertically upward toward the upper trench edge (34). The packing tube (142) is then inserted through the production liner (100 and the packing shoe (140) toward the upper trench edge (34). A slurry (136) containing an unconsolidated material as a relatively permeable material (31) is then pumped into the trench (30) to deposit the unconsolidated material in the trench from the distal trench end (40) to the proximal trench end (42), with the carrier fluid of the slurry (136) being returned to the ground surface through the production liner (100). When the packing of the trench (30) is complete, the packing tube (142) is sheared off and sealed at the packing shoe (140). The packing tube (142) is then removed from the access wellbore (110). This completes construction of the trench (30).

Figure 31:
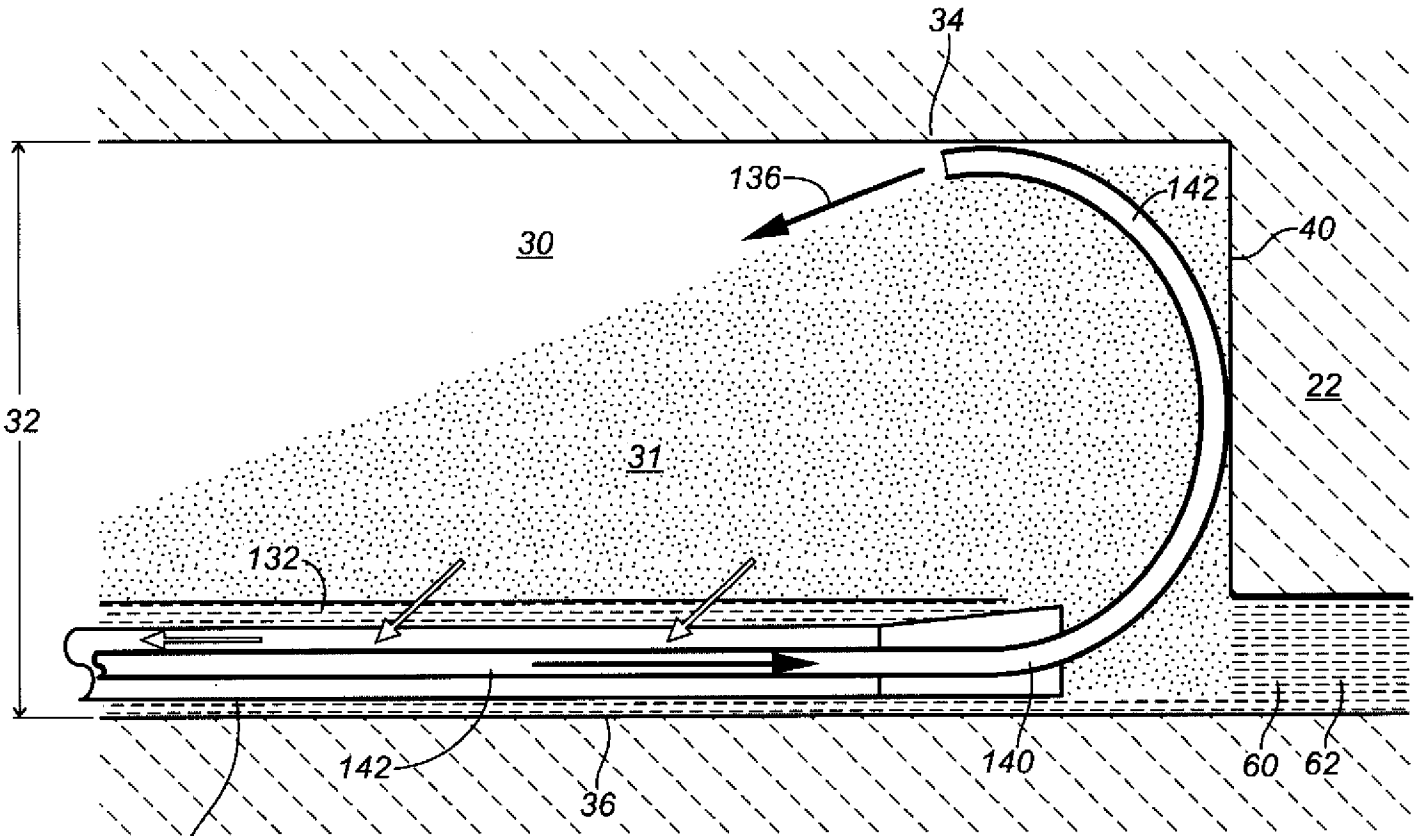
FIG. 31 is a schematic view of an exemplary embodiment of a procedure for packing the trench with a relatively permeable material.

FIG. 31 illustrates schematically the exemplary procedure for packing the trench (30).

3. Constructing a Plurality of Trench Sections

As previously indicated, a trench (30) may be comprised of one or more trench sections (90). In a further exemplary embodiment, the construction of the trench (30) proceeds by constructing trench sections (90) as longitudinal segments of the trench (30), starting at the toe of the SAGD production wellbore (60) and working back toward the heel of the production wellbore (60).

For example, for a production length (62) of a production wellbore (60) which is 800 meters long, the trench (30) could be constructed as eight trench sections (90) which are each 100 meters long. One motivation for this approach could be to limit the length of open access hole that is exposed to the risk of collapse and stuck tooling during construction of the trench (30).

An offsetting incremental cost of this exemplary embodiment is associated with additional trips in and out of the access wellbore (110) in order to form the opening (134) in the sacrificial liner (132) as needed and by the trench cutting tool (114). Once all of the trench sections (90) have been excavated, the installation of the production liner (100) and the packing of the trench (30) with the relatively permeable material (31) may proceed in the same manner as when the trench (30) is comprised of a single trench section (90).

In this embodiment, the general sequence for constructing the system (20) is as follows:

1. provide or drill the SAGD production wellbore (60) as the access wellbore (110);
2. provide or install the sacrificial liner (132) in the production wellbore (60);
3. form the opening (134) in the sacrificial liner (132) in the trench direction (122) along only a first segment of the production length (62) at the distal (toe) end of the production length (62), corresponding to a first trench section (90);
4. excavate the first trench section (90) from the bottom up using the trench cutting tool (114);
5. repeat 3 and 4 until all trench sections (90) are excavated;

6. install the production liner (100) inside the sacrificial liner (132);
7. pack the trench (30) with the relatively permeable material (31) by injecting the slurry (136) at the top of the trench (30) at the distal trench end (40);
8. provide or drill the SAGD injection wellbore (70); and
9. provide or install the injection liner (102) in the injection wellbore (70).

4. Construction of System—Gap Analysis

The trench (30) construction concepts outlined herein are based upon assumptions about the stability of a trench (30) in oil sand and heavy oil formations and upon adaptations of existing technologies to trench (30) construction. These assumptions represent potential technological gaps which may require further engineering analysis and development. A further discussion of key technological gaps follows.

(a) Stability of the Cuts during Trench Excavation

It is assumed that in the normal course of trench (30) construction, use of an appropriate jetting fluid (such as a proven SAGD drilling mud or derivative thereof) and maintenance of at least a balanced pressure condition will provide stable open slots (120). However, stability cannot be guaranteed. Minor or slowly progressing type trench (30) collapses might well be handled by the sacrificial liner (132) and by periodic cleanout of debris from the sacrificial liner (132) as described herein.

On the other hand, a major collapse of the trench (30) during construction, particularly near the heel of the access wellbore (110), could force abandonment of the access wellbore (110), the trench cutting tool (114) and associated equipment, and could also necessitate the drilling of a new access wellbore (110). This could result in significant incremental costs.

(b) Deformable Sacrificial Liner Technologies

Commercially available deformable liner technology appears to focus exclusively on expanding the diameter of the liner (i.e., the intent is to maintain an intact tubular rather than to both rupture and deform the liner). In fact, typical expansion tools take advantage of the ability of the expanded liner to withstand significant internal pressure. Clearly, such tools will not work where the expanded liner is split open or is pre-slotted. Therefore, new approaches to in situ liner deformation will be required to produce the opening (134) in the sacrificial liner (132).

Figure 32:
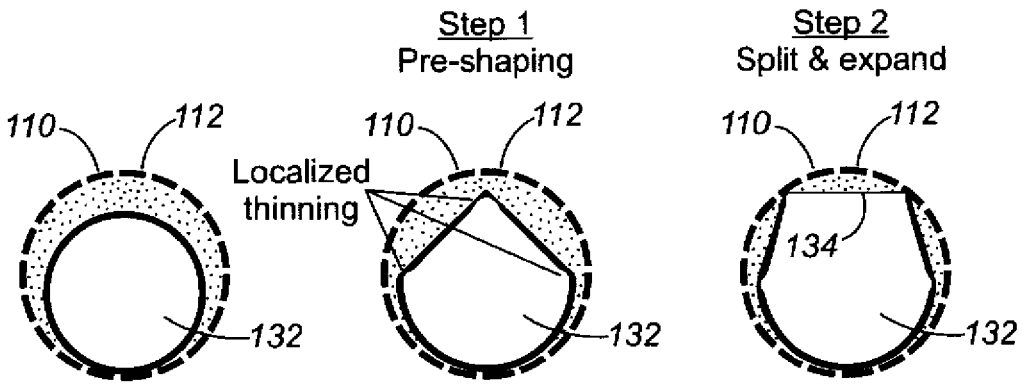
FIG. 32 is a schematic view of an exemplary embodiment of a sequence for forming an opening in a sacrificial liner.

Referring to FIG. 32, the following exemplary sequence may be used for forming the opening (134) in the sacrificial liner (132):

1. anchor the sacrificial liner (132), which would not be pre-slotted at its proximal (i.e., heel) end, to the surrounding casing (not shown) by expanding the sacrificial liner (132) in a conventional manner;
2. push and pump down, from the proximal (i.e., heel) end of the sacrificial liner (132) toward the distal (i.e., toe) end of the sacrificial liner (132), a self-propelled mandrel tool (not shown) with vertical finding ability to pre-shape/thin/score the sacrificial liner (132) in the trench direction (122) without splitting the sacrificial liner (132); and
3. push and pump down a self-propelled mandrel tool (not shown), that orients to the pre-shaped sacrificial liner (132), to split the sacrificial liner (132) in the trench direction (122) and thus form the opening (134) in the sacrificial liner (132) so that the sacrificial liner (132) is effectively U-shaped.

(c) Potential Specialized Features of the Trench Cutting Tool (i) Self-Orienting Shoe If a reliable opening (134) in the sacrificial liner (132) in the trench direction (122) is formed, a self-orienting shoe (not shown) should be capable of orienting to the shape of the deformed sacrificial liner (132).

(ii) Jetting Nozzles

Many different jetting nozzles and multi nozzle tools already exist for down-hole cleanout, radial jet drilling and slurry mining applications. The slurry mining tests by Imperial Oil Limited at Cold Lake demonstrated that even in a fully submerged condition, water cutting jets could be effective at a standoff distance of up to 2.5 meters (i.e., the power of the submerged water jet was effective for cutting the oil sand up to this range). For upwardly directed jets it may be possible to extend the standoff distance or depth of cut by injecting a small volume of gas along with the jetting liquid to create a gas shroud at the cutting surface. Even if extended depth of cut is not desired the use of a gas shroud could increase the efficiency of the high pressure cutting jets.

In any event, the effectiveness of various nozzle designs, jet pressure, submerged or gas shrouded cutting surface and depth of cut will need to be tested and confirmed for each particular formation (22) which is to be cut.

(iii) Making Slots in the Trench Direction

In many embodiments, it will be necessary to advance the water jet cutting device (126) in the trench direction (122), which may typically be upward in a more or less vertical plane, and to hold a more or less constant stand-off distance while the water cutting jets are operating.

A first potential option for achieving this requirement could be to adapt an existing tool that uses an erectable arm in combination with a high pressure hose knuckle joint (not shown).

A second potential option for achieving this requirement could be to use essentially a miniaturized coiled tubing injector (not shown) to erect and retract a short length of tubing that is connected to the trench cutting tool (114) by a high pressure hose. The water jet cutting device (126) could be attached to the end of the short length of tubing. If the short length of tubing were keyed to the body of the trench cutting tool (114) and the trench cutting tool (114) is properly aligned in the sacrificial liner (132), then the water jet cutting device (126) should be capable of advancing in the trench direction (122).

(iv) Logging

The trench cutting tool (114) may be equipped with a logging tool which can provide a mapping of the shape of the trench (30) over the trench length (38). For example, a sonar log that is run as part of each clean-out pass of the trench cutting tool (114) could provide a picture of how the trench (30) excavation is progressing with each advancing/retracting cycle of the trench cutting tool (114) and could be used to adjust parameters such as the rate of traverse, stand-off distance or jetting pressure.

(v) Pumping Tools to Lift Cuttings and Debris

Several slurry mining systems exist that use a jet pump to lift the slurried ore to a ground surface. Therefore, it is likely that the jet pump (130) will also be effective for lifting slurried oil sand and debris from the formation (22). However, analysis and development will be required to determine how to effectively balance the rate of cutting/slurry generation with the rate at which slurry is lifted to the ground surface. Tubing size restrictions will play an important role in this analysis.

(vi) Packing Tools

Conceptually the basic slurry (136) transport mechanism is simple, requiring only a forward depositional wave, advancing from the distal trench end (40) toward the proximal trench end (42). This assumes that the leak-off of the slurry (136) carrier fluid through the relatively permeable material (31) is always much less than the flow to and through the slotted liner at the "yet to be packed" end of the trench (30) toward the proximal trench end (42). Several additional measures may be taken to enhance the effectiveness of the packing procedure.

First, the slots in the production liner (100) could be temporarily blocked or blinded over all but a few tens of meters toward the proximal trench end (42).

Alternatively, pressure within the production liner (100) could be raised to prevent inflow of the slurry (136) carrier fluid, which instead could be returned to surface through a separate second tube (not shown) inserted to the top of the trench (30) at the proximal trench end (42). This measure would require a window in the production liner (100) and the insertion of the second tube from the ground surface.

The volume of the relatively permeable material (31) required to pack the trench (30) will be quite large. This large volume may result in abrasive wear issues for the packing tube (142) and other packing tooling (not shown).

The packing shoe (140) may need to incorporate or be coupled to a miniaturized tubing injector (not shown) to reliably push the discharge end of the packing tube (142) to the top of the trench (30).

(vii) Techniques and Tools for Avoiding/Remediating Trench Collapse

The trench cutting tool (114) will be able to handle minor or slowly developing trench (30) collapse during its periodic cleanout cycles as long as the a collapse does not cause the trench cutting tool (114) to become stuck in the sacrificial liner (132).

It may, however, be useful to equip the trench cutting tool (114) with uphole directed cleanout jets (128) to reduce the risk of the trench cutting tool (114) becoming stuck while being retracted. Excavating the trench (30) as a plurality of trench sections (90) may reduce the risk of the trench cutting tool (114) becoming stuck.

If the trench cutting tool (114) does become stuck in the sacrificial liner (132), it may be possible to feed a small diameter jetting cleanout tool (not shown) into the trench (30) from the ground surface in order to clean out collapsed debris and free the stuck trench cutting tool (114). Once free, the trench cutting tool (114) could be used to complete the cleanout of the sacrificial liner (132) and/or to resume excavating the trench (30).

(viii) Permitted Uses or Disposal of Trench Cuttings

Excavation of the trench (30) could produce as much as 10,000 tonnes or more of trench cuttings. These trench cuttings could therefore produce sufficient volumes of oil sand from the formation (22) to justify processing the trench cuttings at the ground surface in order to recover bitumen therefrom and thereby clean the trench cuttings. In some cases it may even be feasible to separate the coarse sand from the trench cuttings and use the coarse sand as the relatively permeable material (31) for packing the trench (30). The following observations may be relevant to processing possibilities for the trench cuttings:

1. the slurry mining tests conducted by Imperial Oil Limited at Cold Lake demonstrated that water jet cutting and slurrying, without any further processing, facilitates ready separation of bitumen and sand. Sharpe, J. A., Shinde, S. B., Wong, R. C., 1997, Cold Lake Borehole Mining, The Journal of Canadian Petroleum Technology; January 1997, Volume 36, No. 1 reports bitumen separation efficiency greater than 90%;
2. further processing of the slurried trench cuttings, using various technologies that have been developed specifically for drill cuttings treatment, could potentially make the trench cuttings suitable for use as construction fill or for unrestricted disposal;
3. where secondary processing is adopted it may be desirable first to separate the coarser sand from the finer fractions that contain the bulk of any residual oil;
4. dispersed fines, including clays, from the slurried trench cuttings should be amenable to separation and dewatering using various approaches that have been piloted for fine tailings treatment in the mined oil sands industry; and
5. depending upon the delivered cost of unconsolidated material such as high permeability sand or fine gravel, it may prove viable to screen out and use the coarser fractions of the recovered slurried trench cuttings as the relatively permeable material (31) for packing the trench (30).

Figure 33:
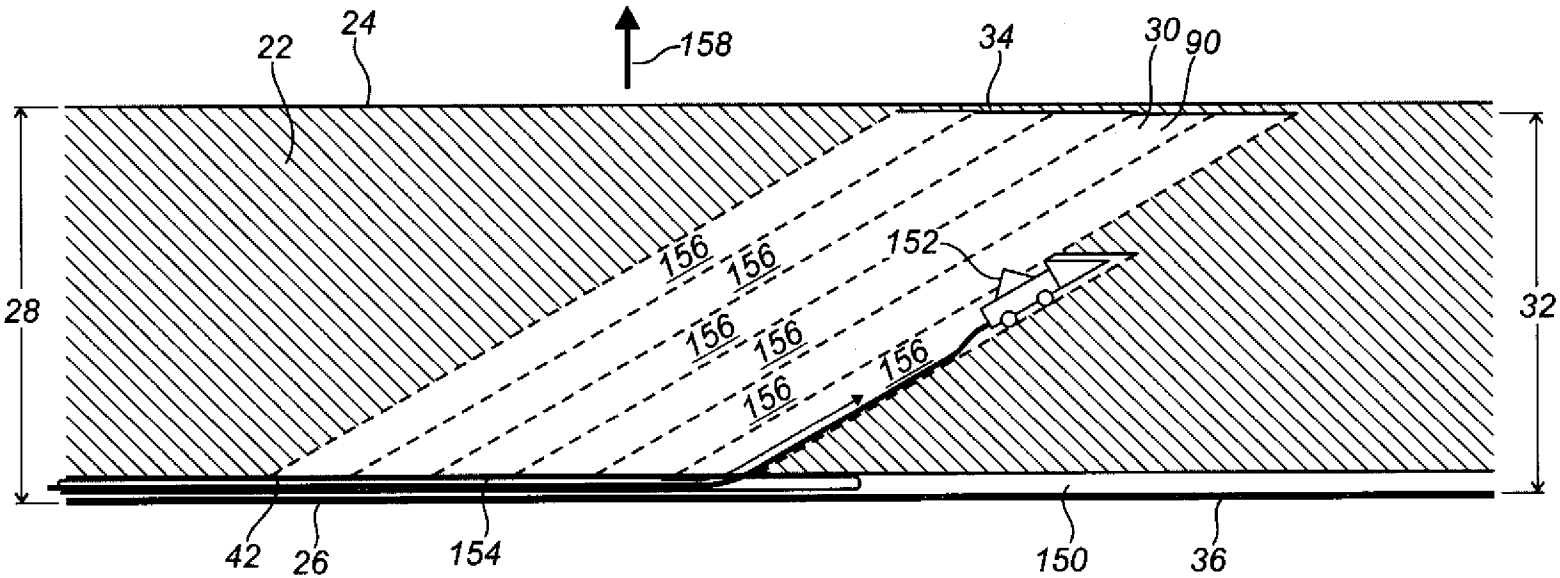
FIG. 33 is a schematic drawing of an alternate embodiment of a method for constructing a trench or a trench section according to the invention.

Referring to FIG. 33, an alternate exemplary embodiment of a method of the invention comprises the following procedure for constructing a trench (30) or a trench section (90):

1 the formation (22) may be accessed from a vertical, directional or horizontal access wellbore (150). A suitable access wellbore (150) is likely to be larger than a typical SAGD production wellbore in order to facilitate the insertion of a suitable trench cutting tool (152) into the access wellbore (150);
2. the trench cutting tool (152) may be inserted into the access wellbore (150) by advancing the trench cutting tool (152) from the ground surface on the end of a pipe string (154);
3. a first upwardly sloping slot (156) may be made by the trench cutting tool (152) from the access wellbore (150) in a trench direction (158), by advancing the trench cutting tool (152) through the access wellbore (150) from a location adjacent to the lower formation boundary (26) to a location below the upper formation boundary (24); and
4. the trench cutting tool (152) may be retracted back to the lower formation boundary (26) and a second upwardly sloping slot (156) may be made by advancing the trench cutting tool (152) through the access wellbore (150), so that the second slot (156) is parallel to and overlaps the first slot (156). The sequence of advancing and retracting the trench cutting tool (152) through the access wellbore (150) may be repeated to make a number of parallel and overlapping upwardly sloping slots (156) in order to complete the trench (30) or the trench section (90).

In the embodiment depicted in FIG. 33, the upward slope of the slots (156) may be any magnitude which is suitable for the trench cutting tool (152) and for the dimensions of the formation (22). A balance is preferably achieved between creating an upward slope which can effectively be climbed by the trench cutting tool (152) and minimizing the length of the upward slope which is required in order for the trench (30) or the trench section (90) to extend to a desired level in the formation (22). A preferred magnitude for the upward slope is between about 5 degrees and about 45 degrees from horizontal. A more preferred magnitude for the upward slope is between about 10 degrees and about 30 degrees from horizontal.

In the embodiment depicted in FIG. 33, the trench cutting tool (152) may be comprised of any apparatus or device or combination of apparatus or devices which is suitable for cutting the upwardly sloping slots (156). In some applications, the trench cutting tool (152) may be comprised of a mechanical cutting device. In some applications, the trench cutting tool (152) may be comprised of a water jet cutting device.

In the embodiment depicted in FIG. 33, the trench cutting tool (152) preferably is capable of generating relatively fine cuttings in order to facilitate lifting of the cuttings back to the ground surface. The cuttings may be lifted back to the ground surface using a suitable transport fluid. Examples of potentially suitable transport fluids include water, water with viscosity modifiers or foaming agents, and drilling mud.

In order to confine the transport fluid and cuttings to the bottom of the trench (30) or the trench section (90) it may be useful to fill the upper portions of the developing trench (30) or trench section (90) with a pressurized inert gas such as nitrogen.

In some applications of the embodiment depicted in FIG. 33, the trench cutting tool (152) may be capable of some amount of self propulsion so that it is not necessary to advance and/or retract the trench cutting tool (152) by manipulating the pipe string (154) from the ground surface. In such applications, the trench cutting tool (152) may be equipped with any self propulsion mechanism (not shown) which is suitable for advancing the trench cutting tool (152) along the upward slope during cutting of the upwardly sloping slots (156). The self propulsion mechanism may be a mechanical mechanism, an hydraulic or pneumatic mechanism, an electrical mechanism, or a combination of suitable mechanisms. As non-limiting examples:

(a) the trench cutting tool (152) may be propelled with an energizing fluid and/or a cuttings transport fluid delivered from the ground surface to the trench cutting tool (152);

(b) the trench cutting tool (152) may be propelled with an energizing fluid and/or a cuttings transport fluid delivered from the ground surface, wherein the fluid is delivered through flexible, high pressure, braided hoses. Preferably, the braided hoses are capable of accommodating many spool-in/spool-out cycles;

(c) the trench cutting tool (152) may be propelled with an energizing fluid and/or a cuttings transport fluid delivered from the ground surface, wherein the fluid may be delivered to an apparatus such as a HydroPull™ Extended Reach Tool, supplied by Tempress Technologies, Inc. of Kent, Wash. The HydroPull™ Extended Reach Tool includes a "water-hammer valve" which creates water-hammer pressure pulses which generate traction power to advance the Tool through a wellbore; or (d) the trench cutting tool (152) may be propelled in a similar manner as the various tunnelling apparatus described in U.S. Patent Application Publication No. US 2007/0039729 A1 (Watson et al).

The trench cutting tool (152) and/or the pipe string (154) to which the trench cutting tool (152) is connected may be equipped with at least a vertical-finding survey tool (not shown) and the capability to align the trench cutting tool (152) relative to vertical.

Where a production length (62) and/or an injection length (72) are to be located within the trench (30), a production liner (100) and/or an injection liner (102) may be installed in the access well (150) and/or into the trench (30) after the trench (30) has been excavated.

The excavated trench (30) may be packed with a relatively permeable material (31) as in other embodiments of the invention.

Although not shown in FIG. 33, the relatively permeable material (31) may be placed in the trench (30) from a packing tube (142) which may be inserted into the trench (30) at an elevation near the top of the trench (30). The packing tube (142) may be run from the ground surface through the access well (150) by sidetrack drilling from a vertical position adjacent to the top of the trench (30). Alternatively, the packing tube (142) may be run from the ground surface through a separate wellbore, such as a SAGD injection wellbore (70) which may intersect the trench (30) at an elevation near the top of the trench (30). The carrier fluid in the slurry (136) which is used to pack the trench (30) may be collected in the production liner (100) in the bottom of the trench (30) and may be returned to the ground surface using a suitable fluid circulation system (not shown).

In the embodiment depicted in FIG. 33, the method may further comprise removing debris from the access wellbore (150). As in other embodiments, the debris may accumulate in the access wellbore (150) as a result of the cutting of the slots (156).

In the embodiment depicted in FIG. 33, removing debris from the access wellbore (150) may be performed in a similar manner as in other embodiments. For example, removing debris from the access wellbore (150) may be comprised of flushing the debris from the access wellbore (150) with the trench cutting tool (152). More particularly, the trench cutting tool (152) may be comprised of one or more cleanout jets, not shown in FIG. 33, which may be operated as the trench cutting tool (152) retracts through the access wellbore (150), and the trench cutting tool (152) may be further comprised of a jet pump, not shown in FIG. 33, for circulating the debris through the access wellbore (150) to the ground surface.

In the embodiment depicted in FIG. 33, debris may be removed from the access wellbore (150) after each of the slots (156) has been cut as the trench cutting tool (152) retracts through the access wellbore (150) in order to cut the next slot (156).

In the embodiment depicted in FIG. 33, the access wellbore (150) may contain a sacrificial liner (not shown in FIG. 33), as in other embodiments. The method may therefore further comprise installing the sacrificial liner in the access wellbore (150) before cutting the slots (156). The sacrificial liner may be deformable as in other embodiments, and the method may further comprise forming an opening (not shown in FIG. 33) in the sacrificial liner in the trench direction (158) before cutting the slots (156) in order to facilitate cutting the slots (156). As in other embodiments, the sacrificial liner may be deformed to provide a U-shaped liner as described above with reference to FIG. 32.

In summary, the system (20) of the invention potentially offers significant benefits for formations (22) containing interbedded shale or other permeability barriers (86). The vertical location of such permeability barriers (86) within the formation (22) as well as their lateral extent will determine the incremental oil recovery and the value provided by a trench (30).

In addition to the more obvious benefits of providing flow paths through well-defined permeability barriers (86), a trench (30) potentially offers significant benefits in overcoming generalized formation (22) heterogeneity, in promoting more rapid and more uniform steam chamber development, in reducing the time required for the SAGD initialization phase, and in providing additional geological information about the formation (22) from analysis of trench cuttings or logging of the trench (30) during excavation of the trench (30).

Trench (30) construction in accordance with the invention should be possible using adaptations of existing well construction and intervention tools and procedures, especially water jetting tools. It is likely that there are many formations (22) where the value of a trench (30) could justify the cost of constructing a system (20) according to the invention.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A system for recovering a fluid from a subterranean formation, the system comprising:

(a) a production wellbore comprising a substantially horizontal production length which extends through the formation at a production length elevation;

(b) a trench extending through the formation, wherein the trench has an upper trench edge, a lower trench edge and a trench length, wherein the upper trench edge is higher than the lower trench eche wherein the trench is substantially planar, and wherein the upper trench edge, the lower trench edge and the trench length define a trench plane; and (c) an injection wellbore comprising a substantially horizontal injection length which extends through the formation at an injection length elevation and wherein the injection length elevation is higher than the production length elevation.

2. The system as claimed in claim 1 wherein the production length and the trench plane are substantially parallel.

3. The system as claimed in claim 2 wherein the trench plane is substantially vertical.

4. The system as claimed in claim 2 wherein the production length is offset laterally from the trench plane.

5. The system as claimed in claim 2 wherein at least a portion of the production length is located within the trench.

6. The system as claimed in claim 2 wherein the trench length extends uninterrupted along a portion of the production length.

7. The system as claimed in claim 6 wherein the formation has a formation thickness and wherein the trench extends through a portion of the formation thickness.

8. The system as claimed in claim 6 wherein the formation has a formation thickness and wherein the trench extends through substantially the entire formation thickness.

9. The system as claimed in claim 2 wherein the trench length extends uninterrupted along substantially the entire production length.

10. The system as claimed in claim 9 wherein the formation has a formation thickness and wherein the trench extends through a portion of the formation thickness.

11. The system as claimed in claim 9 wherein the formation has a formation thickness and wherein the trench extends through substantially the entire formation thickness.

12. The system as claimed in claim 1 wherein the trench is substantially filled with an unconsolidated material.

13. The system as claimed in claim 1 wherein the formation is comprised of a permeability barrier and wherein the trench extends through the permeability barrier.

14. The system as claimed in claim 1 wherein the formation has a formation permeability and wherein the formation permeability is heterogeneous.

15. The system as claimed in claim 1 wherein the production length and the injection length are substantially parallel.

16. The system as claimed in claim 1 wherein the production length, the injection length and the trench plane are substantially parallel.

17. The system as claimed in claim 16 wherein the trench plane is substantially vertical.

18. The system as claimed in claim 16 wherein the production length is offset laterally from the trench plane.

19. The system as claimed in claim 18 wherein the injection length is offset laterally from the trench plane.

20. The system as claimed in claim 18 wherein at east a portion of the injection length is located within the trench.

21. The system as claimed in claim 16 wherein at least a portion of the production length is located within the trench.

22. The system as claimed in claim 21 wherein the injection length is offset laterally from the trench plane.

23. The system as claimed in claim 21 wherein at least a portion of the injection length is located within the trench.

24. The system as claimed in claim 16 wherein the production length and the injection length are substantially coextensive.

25. The system as claimed in claim 24 wherein the trench length extends uninterrupted along a portion of the production length and the injection length.

26. The system as claimed in claim 25 wherein the formation has a formation thickness and wherein the trench extends through a portion of the formation thickness.

27. The system as claimed in claim 25 wherein the formation has a formation thickness and wherein the trench extends through substantially the entire formation thickness.

28. The system as claimed in claim 24 wherein the trench length extends uninterrupted along substantially the entire production length and along substantially the entire injection length.

29. The system as claimed in claim 28 wherein the formation has a formation thickness and wherein the trench extends through a portion of the formation thickness.

30. The system as claimed in claim 28 wherein the formation has a formation thickness and wherein the trench extends through substantially the entire formation thickness.

* * * * *

UNITED STATES PATENT AND TRADEMARK OFFICE

CERTIFICATE OF CORRECTION

PATENT NO. : 8,893,788 B2
APPLICATION NO. : 13/234853
DATED : November 25, 2014
INVENTOR(S) : Cathal Tunney et al.

It is certified that error appears in the above-identified patent and that said Letters Patent is hereby corrected as shown below:

In the Specification,

Column 1, Line 25, after “fluid injection” insert --(i.e.,--

Column 11, Line 47, change “end” to --and--

Column 17, Line 46, change “in” to --m--

Column 24, Line 39, change “imperial” to --Imperial--

Column 29, Line 31, delete “a”

Column 30, Line 23, change “1” to --1.--

In the Claims,

Column 33, Line 21, (Claim 1, line 9), change “eche” to --edge--

Column 34, Line 22, (Claim 20, line 1), change “east” to --least--

Signed and Sealed this
Fifth Day of May, 2015

Michelle K. Lee

Michelle K. Lee
*Director of the United States Patent and Trademark Office*